US007063025B2

(12) United States Patent
Ashby et al.

(10) Patent No.: US 7,063,025 B2
(45) Date of Patent: Jun. 20, 2006

(54) TABLE WITH FOLDABLE LEGS

(75) Inventors: Kent Ashby, Logan, UT (US); S. Curtis Nye, Clinton, UT (US); David C. Winter, Layton, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/821,566

(22) Filed: Apr. 9, 2004

(65) Prior Publication Data

US 2004/0255826 A1 Dec. 23, 2004

Related U.S. Application Data

(63) Continuation-in-part of application No. 29/179,353, filed on Apr. 9, 2003, now Pat. No. Des. 501,103, which is a continuation-in-part of application No. 29/179,374, filed on Apr. 9, 2003, now Pat. No. Des. 502,028.

(60) Provisional application No. 60/461,492, filed on Apr. 9, 2003.

(51) Int. Cl.
*A47B 3/00* (2006.01)

(52) U.S. Cl. ..... 108/129

(58) Field of Classification Search ..... 108/124, 108/125, 126, 129, 130, 131, 132, 160, 12; 248/167, 188.6, 439
See application file for complete search history.

(56) References Cited

U.S. PATENT DOCUMENTS

| | | | | | |
|---|---|---|---|---|---|
| 441,569 | A | * | 11/1890 | Ladd | 5/313.1 |
| 2,004,696 | A | * | 6/1935 | Heath | 108/160 |
| 2,029,433 | A | * | 2/1936 | Kearsley | 312/280 |
| 2,075,778 | A | * | 3/1937 | Johannsen | 108/131 |
| D142,171 | S | * | 8/1945 | Lion | D34/21 |
| 2,385,717 | A | * | 9/1945 | Mayer | 108/125 |
| 2,448,360 | A | * | 8/1948 | De Saussure | 108/132 |
| 2,514,061 | A | * | 7/1950 | Hood | 108/130 |
| 3,120,976 | A | * | 2/1964 | Syoc | 297/60 |
| 3,123,935 | A | * | 3/1964 | Williams | 248/346.01 |
| 3,554,141 | A | * | 1/1971 | Burr | 108/132 |
| 3,662,694 | A | * | 5/1972 | Mitchell | 108/131 |
| 3,818,844 | A | * | 6/1974 | Burr | 108/132 |
| 3,845,728 | A | * | 11/1974 | Piretti | 108/131 |
| 3,945,328 | A | * | 3/1976 | Hendrickson et al. | 108/132 |
| 4,063,703 | A | * | 12/1977 | Shy | 248/439 |
| 4,237,795 | A | * | 12/1980 | Parker | 108/12 |
| 4,424,912 | A | * | 1/1984 | Bieri et al. | 217/122 |
| 4,444,124 | A | * | 4/1984 | Burr | 108/131 |

(Continued)

*Primary Examiner*—Jose V. Chen
(74) *Attorney, Agent, or Firm*—Workman Nydegger

(57) ABSTRACT

A table may include a table top, a frame and one or more legs. The legs are preferably pivotally attached to the frame by brackets and the brackets may be rotatable with respect to the table top. The table may also include a drawer and the legs may be sized and configured to be disposed about the drawer when the legs are in a collapsed position. In addition, one or more links may be used to connect the brackets to the frame, if desired.

29 Claims, 21 Drawing Sheets

U.S. PATENT DOCUMENTS 4,658,735 A * 4/1987 Holton ..... 108/131
5,070,796 A * 12/1991 Marone et al. ..... 108/124
5,102,079 A * 4/1992 Lee ..... 248/166
5,259,305 A * 11/1993 Korb ..... 108/129
5,284,100 A * 2/1994 Thorn ..... 108/129
5,437,298 A * 8/1995 Lin ..... 135/117
D362,983 S 10/1995 Magnusson
5,465,673 A * 11/1995 Ma ..... 108/118
D376,712 S 12/1996 Mezger
6,109,191 A * 8/2000 Schworer ..... 108/115
D444,001 S 6/2001 Minami
D448,216 S 9/2001 Kolberg
D455,918 S 4/2002 Moore
D463,164 S 9/2002 Davis
D463,695 S 10/2002 Patik
D465,359 S 11/2002 Kolberg
D486,329 S 2/2004 Strong et al.
6,920,832 B1 * 7/2005 Lou-Hao ..... 108/132

* cited by examiner

TABLE WITH FOLDABLE LEGS

CROSS-REFERENCE TO RELATED APPLICATIONS

This application claims priority to and the benefit of U.S. Provisional Patent Application Ser. No. 60/461,492, entitled TABLE, which was filed on Apr. 9, 2003. This application is a continuation-in-part of U.S. Design patent application Ser. No. 29/179,353, entitled TABLE, which was filed on Apr. 9, 2003 now U.S. Pat. No. d501,103, and this application is a continuation-in-part of U.S. Design patent application Ser. No. 29/179,374, entitled TABLE, which was filed Apr. 9, 2003 now U.S. Pat. No. d502,028. Each of these applications are incorporated by reference in their entireties.

BACKGROUND OF THE INVENTION

1. Field of the Invention

The present invention generally relates to furniture and, in particular, to tables.

2. Description of Related Art

Conventional tables typically include one or more legs that are connected to a table top. Many conventional tables include folding legs to allow the table to be more easily transported and stored. In particular, conventional tables often include legs that are pivotally attached to the table top to allow the legs to be moved between an extended position in which the legs extend outwardly from the table top and a collapsed or storage position in which the legs are positioned near or adjacent to the table top. Thus, when the table is desired to be used, the legs are placed in the extended position. On the other hand, when the table is desired to be transported or stored, the legs can be placed in the collapsed or storage position.

The legs of many conventional tables are pivotally connected to the table top and the legs are frequently constructed from hollow metal tubes. The table tops of conventional tables are often constructed from materials such as metal or wood. In particular, conventional table tops may be constructed from materials such as steel, aluminum, plywood, particle board, fiber board, and other types of wooden laminates. Table tops constructed from wood or metal, however, are often relatively heavy and this may make the table awkward or difficult to move. Conventional table tops constructed from wood or metal are also relatively expensive and the table tops must generally be treated or finished before use. For example, table tops constructed from wood are often sanded and/or painted, and table tops constructed from metal must be formed or cut into the desired shape and painted or otherwise finished. In addition, metal or wooden table tops often require a canvas or vinyl cover, which undesirably increases the costs of the table.

Conventional table tops constructed from materials such as plywood, particle board, fiber board or wooden laminates are often not very strong or rigid. These known types of tables often cannot support large or heavy items, and these types of tables generally cannot withstand large forces or impacts without breaking or cracking. For example, the wooden table tops may split or shatter, or the legs may become disconnected from the table top.

Card tables are well known types of tables that traditionally include table tops constructed from plywood, particle board or fiber board. Conventional card tables typically include table tops with generally planar, flat upper surfaces. Conventional card tables are also relatively lightweight and can be easily transported. Most conventional card tables include four legs that are each independently connected to the table top. Specifically, the legs of most known card tables are pivotally connected to the table top by a brace with an elongated slot. The slotted brace allows each leg to individually fold against the table top. The slotted brace may also be sized and configured to lock the leg in the extended and/or collapsed position.

Conventional card tables often include a vinyl or plastic covering of the pressed wood or particle board table top. The vinyl or plastic covering, however, often undesirably increases manufacturing time and costs. Additionally, the vinyl or plastic covering may be easily torn or damaged, and it may be very difficult or impossible to satisfactorily repair or replace. As discussed above, table tops constructed from pressed wood or particle board table top are not very strong and the legs are often not securely connected to the table top. This may allow the legs to wobble or otherwise undesirably move. The legs may also become disconnected or break away from the table top if an excessive load or force is placed on the table top or legs. Damaged or broken card tables are typically discarded and new card tables purchased because card tables are often difficult to fix or repair.

Conventional tables with table tops constructed from wood or metal may be relatively heavy, which makes the table more difficult to move and more expensive to ship and transport. In order to decrease the weight of these known tables, the table tops can be constructed from lightweight materials such as plastic. In particular, the table tops can be constructed from injection molded plastic to form thin, lightweight table tops. Disadvantageously, these lightweight table tops frequently require reinforcing members or other structural parts such as brackets, support members and the like to strengthen the table top. While these additional parts may increase the strength of the table top, they undesirably increase the weight of the table. In addition, these additional parts increase manufacturing costs and require additional time to assemble the table. Furthermore, these additional parts may have sharp edges that can injure a user's arms or legs.

BRIEF SUMMARY OF THE INVENTION

A need therefore exists for a table that eliminates the above-described disadvantages and problems.

One aspect of the invention is a table with one or more legs than may be movable between an extended position and a collapsed position. Advantageously, when the legs are in the extended position, the table can be used to support various items and/or for many different purposes. When the legs are in the collapsed position, the table can be easily transported and stored. Preferably, when the legs are in the collapsed position, the legs are stored near or adjacent to the table top. The legs, however, could be removably connected to the table top.

Another aspect is a table that may include legs that are pivotally connected to the table top. Significantly, if the legs are pivotally connected to the table top, then the legs may be quickly and easily moved between extended and collapsed positions. The legs may be independently connected to the table top so that each of the legs can be separately moved between the extended and collapsed positions. One or more of the legs may also be interconnected to allow the interconnected legs to be simultaneously moved between the extended and collapsed positions.

Yet another aspect is a table that may include a drawer. The drawer is preferably slidably attached to the table so that it can be opened by pulling or drawing it out, and it can be closed by pushing it in. The drawer is preferably a box or receptacle with a generally square or rectangular configuration, but it could have other suitable shapes and sizes. Desirably, the drawer is attached to a lower or bottom surface of the table top by one or more grooves, tracks, wheels or the like. The drawer, however, could be attached to the table by any suitable means and the drawer could be rotatably or removably attached to the table, for example.

Still another aspect is a table that may include a drawer and legs that are pivotally attached to the table. Significantly, the legs may be attached to the table top to allow the legs to be moved between extended and collapsed positions. In addition, the legs may be connected to the table top to allow the legs to be disposed about the drawer when the legs are in the collapsed position. Thus, the table may include a drawer and the legs may be folded around the drawer when the legs are in the collapsed position.

A further aspect is a table that may include legs than can be locked into an extended and/or collapsed position. For example, one or more pins or detents may be used to secure the legs in the extended and/or collapsed positions.

A still further aspect is a table that may include a frame that is used to attach one or more legs to the table top. The frame may include one or more side rails that extend along a side of the table and the legs may be attached to the side rails. The side rails may be rotatably attached to the table top to allow the legs to be rotated relative to the table top. For example, when the legs are in the collapsed position, the side rails of the frame may be rotated to position the legs proximate or adjacent to a lower surface of the table top.

Yet another aspect is a table that may include one or more legs that are pivotally attached to the table top by one or more links. The links may provide a dual pivot connection of the legs to the table top. Advantageously, this may allow the legs to be disposed about a drawer when the legs are in the collapsed position. This may also allow the legs to be securely connected to the table top or a frame.

Another aspect is a table that may be specifically sized and configured to be used by only one person at a time. This type of table may be referred to as a personal table. The table, however, could be larger or smaller and suitable number of persons could use the table. The table preferably includes a drawer, which may be a boxlike container that slides in and out relative to the table top. Advantageously, the drawer provides space to store various items such as pencils, pens, paper, paper clips, letters, keys, and the like. Significantly, the drawer may be used in connection with a personal or other type of table to allow a person to store various items.

Yet another aspect is a table that may be relatively small and lightweight, which may allow the table to be easily moved and transported. The table may also be sized and configured so that it does not take up any unnecessary space.

Still another aspect is a table that may include a table top that is constructed from a lightweight material, which may allow a single person to readily lift and move the table. Desirably, the table top is constructed from plastic, such as high density polyethylene, and the table top may be constructed by blow-molding. The blow-molded plastic table tops may be designed to create rigid, high-strength structures that are capable of withstanding repeated use and wear. Advantageously, the blow-molded plastic table tops can easily be manufactured and formed into the desired shapes and sizes. In addition, the blow-molded plastic table tops can form structural components of the table, which may minimize the number of components required to construct the table.

A further aspect is a table that may include a table top with one or more features integrally formed in the table top. For example, the table could include a blow-molded plastic table top and one or more features may be integrally formed in the table top during the blow-molding process as part of a unitary, one-piece structure. These features may include, but are not limited to, a recessed portion formed in the bottom of the table top or a generally downwardly lip that may form part of an outer edge of the table top.

Advantageously, the table may be relatively simple to manufacture because it preferably consists of a table top constructed from blow-molded plastic. The blow-molded plastic table top may include two opposing walls that are spaced apart by a relatively small distance, which may increase the strength and rigidity of the table top. The blow-molded plastic table top may also include one or more depressions or tack-offs to further increase the strength of the table top and/or interconnect the spaced apart walls. Significantly, the blow-molded table top may be lightweight, rigid, durable, weather resistant and generally temperature insensitive. Additionally, the blow-molded plastic table top may not corrode, rust or otherwise deteriorate over time. Further, the blow-molded table top can also be formed in various shapes, sizes, configurations and designs.

In addition, the table may be quickly and easily assembled, which may reduce manufacturing and labor costs. Further, the table may be used in wide variety of situations and uses. For example, the table may be used to support various items such as a television, computer, sewing machine, microwave, lamp, luggage, and the like. The table can also be used as a bedside table, coffee table, night stand, desk, shop table, and the like. Further, the table can be used while performing a wide variety of tasks such as reading, writing, studying, working, etc. Thus, the game table can be used in a number of different environments and it can perform numerous different tasks.

Further, if the table includes a drawer, then the drawer may provide a suitable location to place and store various objects and things. The drawer may also provide an efficient and convenient location to store articles such as papers, pencils, pens and the like.

Another aspect is the table may include a table top and a frame secured to the table top. The frame may include a first side rail and a second side rail, and the first and second side rails may extend along opposing sides of the table and the side rails may extend at least a majority of a length of the table or substantially the entire length of the table. The table may also include a first bracket with one end pivotally connected to the first side rail of the frame and a first leg connected to an opposing end of the first bracket, the first leg movable between an extended position and a collapsed position relative to the table top. In addition, the table may include a second bracket with one end pivotally connected to the first side rail of the frame and a second leg connected to an opposing end of the second bracket, the second leg movable between an extended position and a collapsed position relative to the table top. Further, the table may include a third bracket with one end pivotally connected to the second side rail of the frame and a third leg connected to an opposing end of the third bracket, the third leg movable between an extended position and a collapsed position relative to the table top. Finally, the table may include a fourth bracket with one end pivotally connected to the second side rail of the frame and a fourth leg connected to an opposing end of the fourth bracket, the fourth leg movable between an extended position and a collapsed position relative to the table top.

Advantageously, the table may include a drawer and the drawer may be attached to the table top or the frame. Desirably, the first leg, the second leg, the third leg and the fourth leg may be sized and configured to be disposed about the drawer when the legs are in the collapsed position. In addition, the first side rail may be rotatably connected to the table top and the second side rail may rotatably connected to the table top to allow the legs to be positioned generally adjacent to a lower surface of the table top. Further, a first link may be used to connect the first leg to the opposing end of the first bracket, a second link may be used to connect the second leg to the opposing end of the second bracket, a third link may be used to connect the third leg to the opposing end of the third bracket, and a fourth link may be used to connect the fourth leg to the opposing end of the fourth bracket. The table may also include one or more pins to secure the legs in a fixed position and one or more clips to secure portions of the legs or frame in a desired position.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

The present invention is generally directed towards a table with legs that are movable between an extended position and a collapsed position relative to the table top. The principles of the present invention, however, are not limited to tables with legs that are movable between extended and collapsed positions relative to the table top. It will be understood that, in light of the present disclosure, the table disclosed herein can be successfully used in connection with other types of furniture, fixtures and equipment.

Additionally, to assist in the description of the table, words such as top, bottom, front, rear, right and left are used to describe the accompanying figures. It will be appreciated, however, that the present invention can be located in a variety of desired positions—including various angles, sideways and even upside down. A detailed description of the table now follows.

Figure 1:
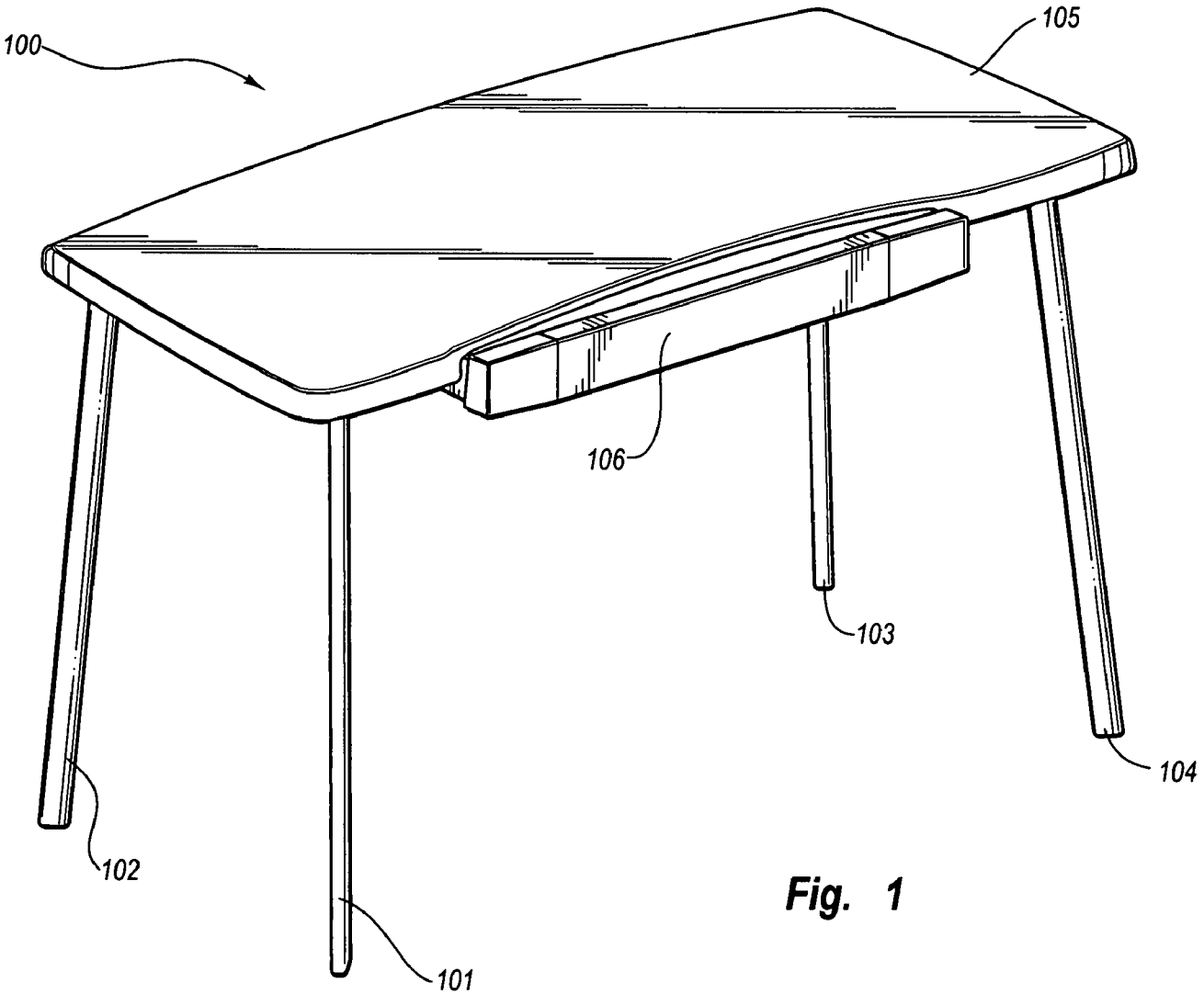
FIG. 1 is a top perspective view of an exemplary embodiment of a table.
Figure 2:
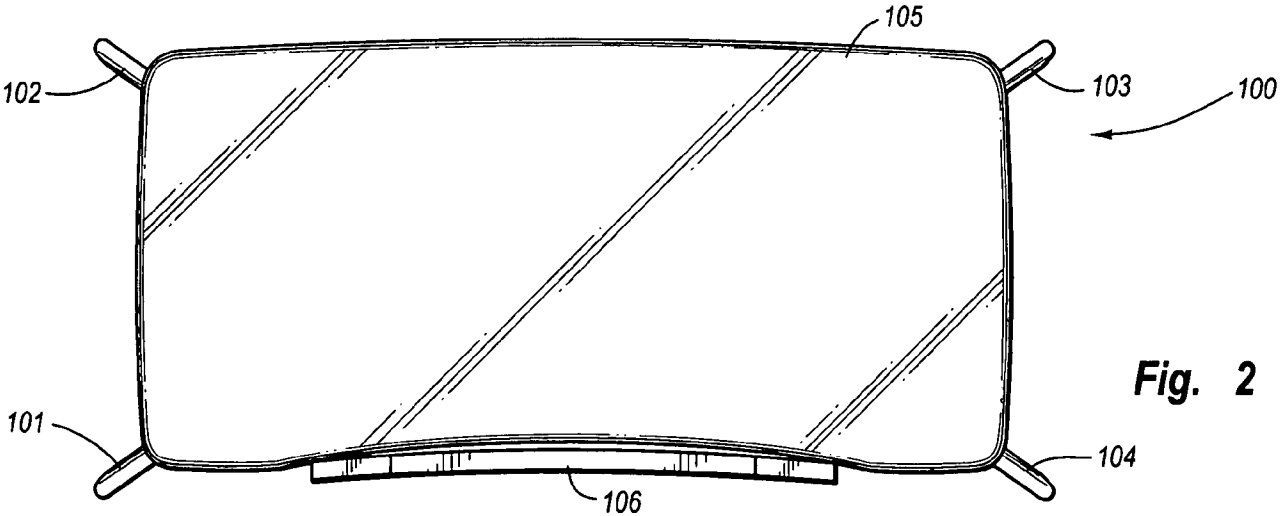
FIG. 2 is a top view of the table shown in FIG. 1.

As seen in FIG. 1, an exemplary embodiment of a table 100 includes including one or more legs (e.g., legs 101, 102, 103, and 104), a table top 105 and a drawer 106. The drawer 106 is preferably slidably attached to a lower surface of the table top 105 and it is preferably movable between a closed position in which all or a majority of the drawer is disposed under the table top and an open position in which a majority of the drawer extends outwardly from underneath the table top. The drawer 106 may include a lip or handle to facilitate opening or closing of the drawer. The drawer 106 may also include a front surface that is sized and configured to contact or abut a portion of the table top 105, such as an edge or front portion of the table top. One skilled in the art will appreciate that the drawer 106 could have a variety of suitable designs and arrangements depending, for example, upon the intended use of the drawer and/or table 100.

The drawer 106 is preferably slidably connected to the table 100. For example, the drawer 106 could be slidably connected to the table 100 by one or more guides, tracks, pathways, and the like. The drawer 106 could also be slidably connected to the table 100 by one or more grooves, rollers, wheels, and the like. Advantageously, the drawer 106 could be connected to any suitable portion of the table 100 such as the table top 105 or the legs 101, 102, 103, 104. It will be understood that the drawer 106 could also be rotatably, selectively, or otherwise connected to the table 100.

The drawer 106 is preferably sized and configured to allow one or more items to be stored in the drawer. For example, the drawer 106 may have a generally rectangular configuration and it may be sized and configured to hold items such as pencils, pens, paper, books, notebooks and the like. The drawer 106 could also have other suitable configurations such as square, triangular and the like, depending, for example, upon the intended use of the drawer and/or table 100. One skilled in the art will understand that the drawer 106 could have a variety of suitable configurations and designs.

The table 100 may be sized and configured for use by an individual or it may be sized and configured for use by more than one person. For example, if the table 100 is sized and configured for use by a single person, then it may have a relatively small table top 105. On the other hand, if the table 100 is sized and configured to be used by more than one person, it may have a larger size. In addition, the table 100 may be sized and configured for particular uses, such as a personal table, computer table, game table, bedside table, night stand, television table, utility table, and the like. The table 100 may also be sized and configured for particular uses such as a desk. Thus, while the table 100 could be specifically sized and configured for a particular use or activity, the table could have various suitable configurations and arrangements depending, for example, upon the intended use of the table or it could have a general shape and design that allows it to be used in a wide variety of situations and circumstances.

As shown in FIG. 1, the table top 105 may have a generally rectangular configuration with rounded corners and slightly rounded outer edges. For example, the table top 105 may be about forty-eight (48) inches in length and about twenty-four (24) inches in width, but one skilled in the art will appreciate that the table top can have other suitable sizes and configurations. Thus, the table top 105 may be larger or smaller and the table top can have other configurations such as square, circular, oval, and the like depending, for example, upon the intended use of table 100.

As shown in FIG. 1, the table top 105 may include beveled, sloped or rounded surfaces disposed between the top surface and the sides of the table 100. The beveled surfaces may be sized and configured to increase the comfort of the person(s) using the table 100, but the table does not require beveled surfaces. In addition, the corners and edges of the table top 105 do not have to be rounded and, in contrast, the corners and edges could have any desirable configuration, but the rounded features may increase the comfort and/or safety of the person(s) using the table.

The table top 105 is preferably constructed from a lightweight material and, more preferably, the table top is constructed from plastic, such as high density polyethylene. The plastic table top 105 is desirably formed by a blow-molding process because, for example, it allows a strong, lightweight, rigid and sturdy table top to be quickly and easily manufactured. Advantageously, the blow-molded plastic table top 105 has a lighter weight than conventional table tops constructed from wood or metal, and the blow-molded plastic table top can be constructed from less plastic than conventional plastic table tops, which may save manufacturing costs and reduce consumer costs. In particular, the blow-molded table top 105 can be manufactured with thin plastic walls and that allows the table top to cool faster during the manufacturing process, which decreases the manufacturing time.

Further, the blow-molded plastic table top 105 can be constructed to form a variety of suitable shapes, configurations, sizes, designs and/or colors depending, for example, upon the intended use of table 100. For example, the table top 105 can be constructed with a generally rectangular configuration of about thirty-six (36) inches by about forty (40) inches. The table top 105 could also have a generally circular configuration with a diameter of about thirty (30) inches or a generally square configuration with thirty-six inch (36) sides. Of course, the blow-molded table top 105 can have any suitable size and configuration depending, for example, upon the intended use of the table 100.

The table top 105 is preferably constructed from blow-molded plastic because blow-molded plastic table tops are durable, weather resistant, generally temperature insensitive, corrosion resistant, rust resistant, and generally do not deteriorate over time. One skilled in the art, however, will appreciate that the table top 105 does not have to be constructed from blow-molded plastic and other suitable materials and/or processes can be used to construct the table top depending, for example, upon the intended use of the table 100. Thus, the table top 105 could be constructed from other materials with suitable characteristics, such as wood, metal and other types of plastic. Additionally, the table top 105 does not have to be constructed from blow-molded plastic and it could be constructed from injection molded plastic, extrusion molded plastic, and the like.

The table top 105 may include one or more features that are integrally formed in the table top as part of a unitary, one-piece structure. For example, the table top 105 may include a generally downwardly extending lip that is disposed about the outer portion of the table top. The table top 105 could also include a recess that is formed in the lower surface of the table top which may be sized and configured to receive at least a portion of the legs 101, 102, 103, 104 when the legs are in the collapsed position. Advantageously, this may facilitate stacking of the tables 100 if the legs 101, 102, 103, 104 do not extend beyond a plane that is generally aligned with a lower surface of the table top 105. It will be appreciated that the table top 105 could have any suitable number of features, but the table top does not require any particular features or number of features.

Figure 3:
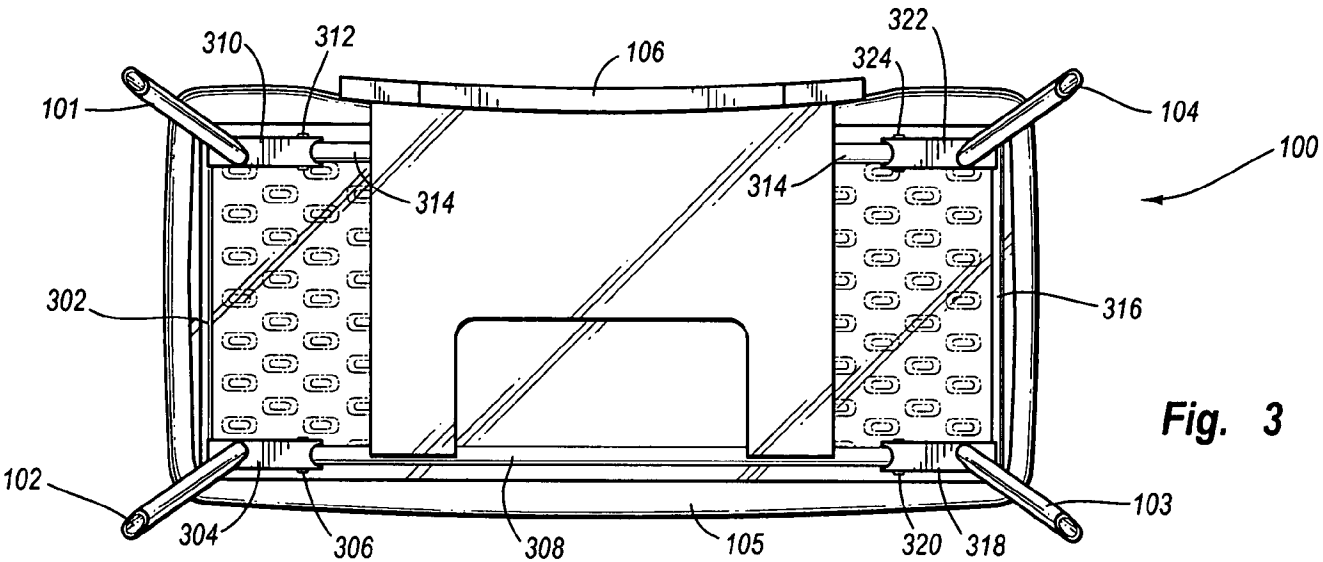
FIG. 3 is a bottom view of the table shown in FIG. 1.

As shown in FIG. 3, the table 100 may include a frame and the table top 105 may be connected to the frame. The frame, for example, may include a side rail 308 disposed on one side of the table top 105 and another side rail 314 disposed on the other side of the table top. A bracket 304 may be pivotally attached to the side rail 308 of the frame by a pin 306 and the leg 102 may be attached to the bracket. In addition, a bracket 310 may be pivotally attached to the side rail 314 by a pin 312, a bracket 318 may be pivotally attached to the side rail 308 by a pin 320, and a bracket 322 may be pivotally attached to the side rail 314 by a pin 324. The brackets 310, 318 and 322 may allow the legs 101, 103, 104 to be connected to the side rails 308, 314 of the frame., One skilled in the art will appreciate that the brackets 304, 310, 318 and 322 may be connected to any suitable portions of the frame or table top 105, and the brackets could be connected by any suitable manner or method. One skilled in the art will also appreciate that the legs 101, 102, 103, 104 may be connected to the frame or table top 105 by other suitable types of brackets or connectors.

The legs 101, 102, 103, 104 are preferably securely connected to the brackets 304, 310, 318, 322, respectively, but the legs could also be pivotally connected to the brackets if desired. While the legs 101, 102, 103, 104 and brackets 304, 310, 318, 322 are preferably separate components that are interconnected, the legs and brackets could also be formed as single members depending, for example, upon the intended use of the table 100.

The brackets 304 and 310 are preferably interconnected by a crossbar 302, and the brackets 318, 322 are preferably interconnected by a crossbar 316. Thus, the legs 101 and 102 are interconnected by the crossbar 302 and the legs 103 and 104 are interconnected by the crossbar 316. Advantageously, this may create a pair of legs disposed at each end of the table 100. In addition, if one of the legs is moved between the extended and collapsed positions, then the other leg will simultaneously move between the extended and collapsed positions. This may allow the legs 101, 102, 103, 104 of the table 100 to be quickly and easily moved between the extended and collapsed positions. One skilled in the art will appreciate that the legs 101, 102, 103, 104 do not have to be interconnected by the crossbars 302, 316.

The crossbars 302, 316 and side rails 308, 314 are preferably located near the outer edges of the table top 105 to help create a sturdy and stable table 100. The crossbars 302, 316 and side rails 308, 314, however, could be spaced inwardly from the outer edges of the table top 105 if desired. In addition, the crossbars 302, 316 do not have to be connected to the brackets 304, 310, 318, 322, respectively. Instead, the crossbars 302, 316 could be connected to the side rails 308, 314 of the frame. The table 100, however, does not require the use of either the side rails 308, 314 or the crossbars 302, 316. In addition, one skilled in the art will understand that the frame, crossbars 302, 316 and side rails 308, 314 could have other suitable configurations and arrangements depending, for example, upon the size and shaped of the table top 105 and/or intended use of the table 100.

The legs 101, 102, 103, 104, crossbars 302, 316 and side rails 308, 314 are preferably constructed from relatively strong materials such as metal. In particular, the legs 101, 102, 103, 104, crossbars 302, 316 and side rails 308, 314 may be constructed from steel tubes and these components may be finished, for example by painting or powder coating, to protect the components from the elements. Advantageously, the steel tubes may help create a table 100 that is strong and able to support a relatively large amount of weight. The steel tubes may have circular, elliptical, polygonal, oblong, square or other suitable cross-sectional shapes, and these components may have a uniform or non-uniform cross-section along its length. The legs 101, 102, 103, 104, crossbars 302, 316 and/or side rails 308, 314, however, may be constructed from any materials with appropriate characteristics and these components can have any suitable size and shape.

Figure 4:
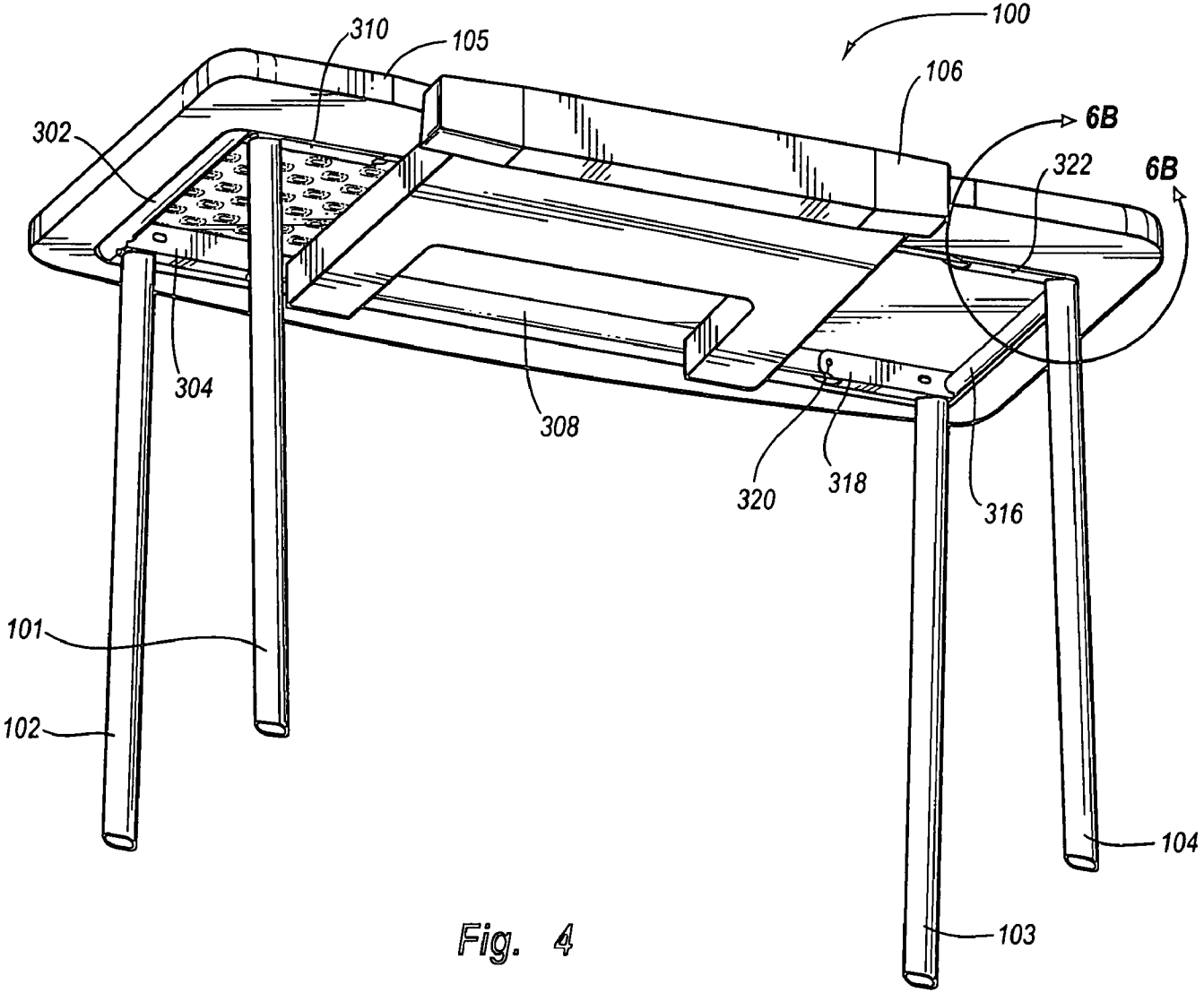
FIG. 4 is a bottom perspective view of the table shown in FIG. 1, illustrating the legs in an extended position.
Figure 5:
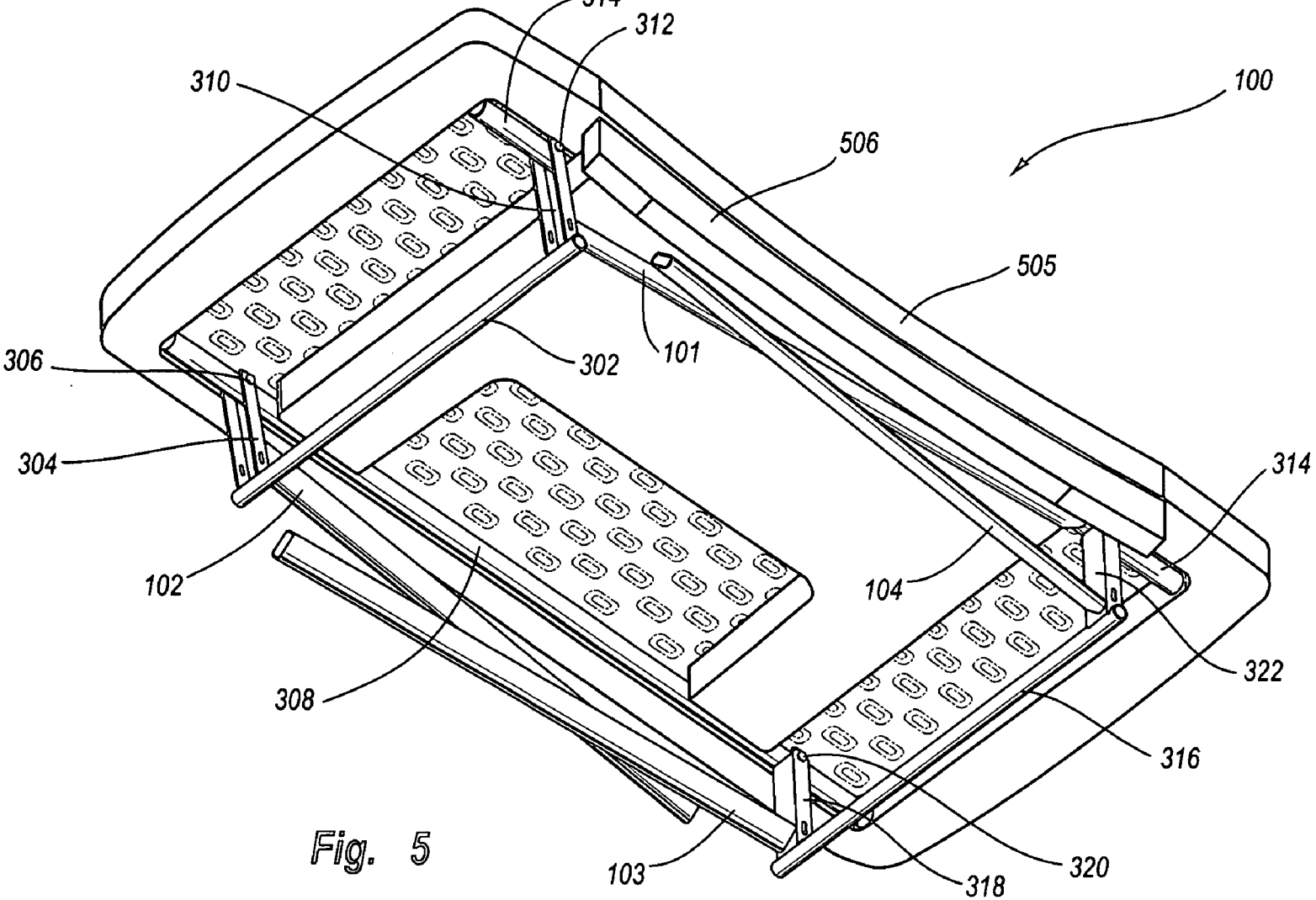
FIG. 5 is a bottom perspective view of the table shown in FIG. 1, illustrating the legs in a collapsed position.

As shown in FIG. 4, when the legs 101, 102, 103, 104 are in the extended position, the legs are preferably disposed near the corners of the table 100. Advantageously, this may help create a stable and sturdy table 100. The legs 101, 102, 103, 104, however, could be located in any desired portions. As shown in FIG. 5, when the legs 101, 102, 103, 104 are in the collapsed or storage position, the legs are disposed about the drawer 106. This creates a table 100 with a drawer 106 that allows the legs to be moved between an extended position and a collapsed position.

As seen in FIGS. 3 and 4, the lower surface of the table top 105 may include a plurality of depressions. The depressions preferably cover at least a substantial portion of the lower surface of the table top 105 and the depressions preferably extend towards and/or contact the upper surface of the table top. In particular, the ends of the depressions may engage, contact or abut the inner surface of the upper surface of table top 105 or the ends of the depressions may be spaced from the upper surface of the table top. As best seen in FIG. 3, the depressions may be formed in a predetermined pattern or array, and the depressions may be placed in a staggered, geometric, random or suitable arrangement.

The depressions may be designed to increase the strength and structural integrity of the table 100. While it was previously believed that stronger structures were provided by making the walls thicker and/or adding structures such as ribbing, the depressions may provide the surprising and unexpected result that an increased number of depressions may provide a stronger structure and/or thinner walls may be used to construct the structure. Surprisingly, the depressions may increase the structural integrity of the structure despite forming disruptions in the continuity of the lower surface of the table top 105, and less plastic can be used to make the structure even though the plurality of depressions are formed in the structure. The costs of manufacturing and transportation may be decreased because thinner plastic walls may be used to construct the table top 105, which may create a lighter weight table 100.

Additionally, when blow-molded structures such as table tops 105 are formed, a certain amount of time must elapse before the structure can be removed from the mold. Blow-molded structures with thicker walls require a longer cooling time than structures with thinner walls. The depressions, however, may allow table tops 105 with thinner plastic walls to be constructed and that reduces the cooling time before the table tops can be removed from the mold. Significantly, a reduced cycle time may increase the efficiency of manufacturing process and the cost of the table 100 may be reduced because less plastic may be used to make the table top 105.

Figure 6:
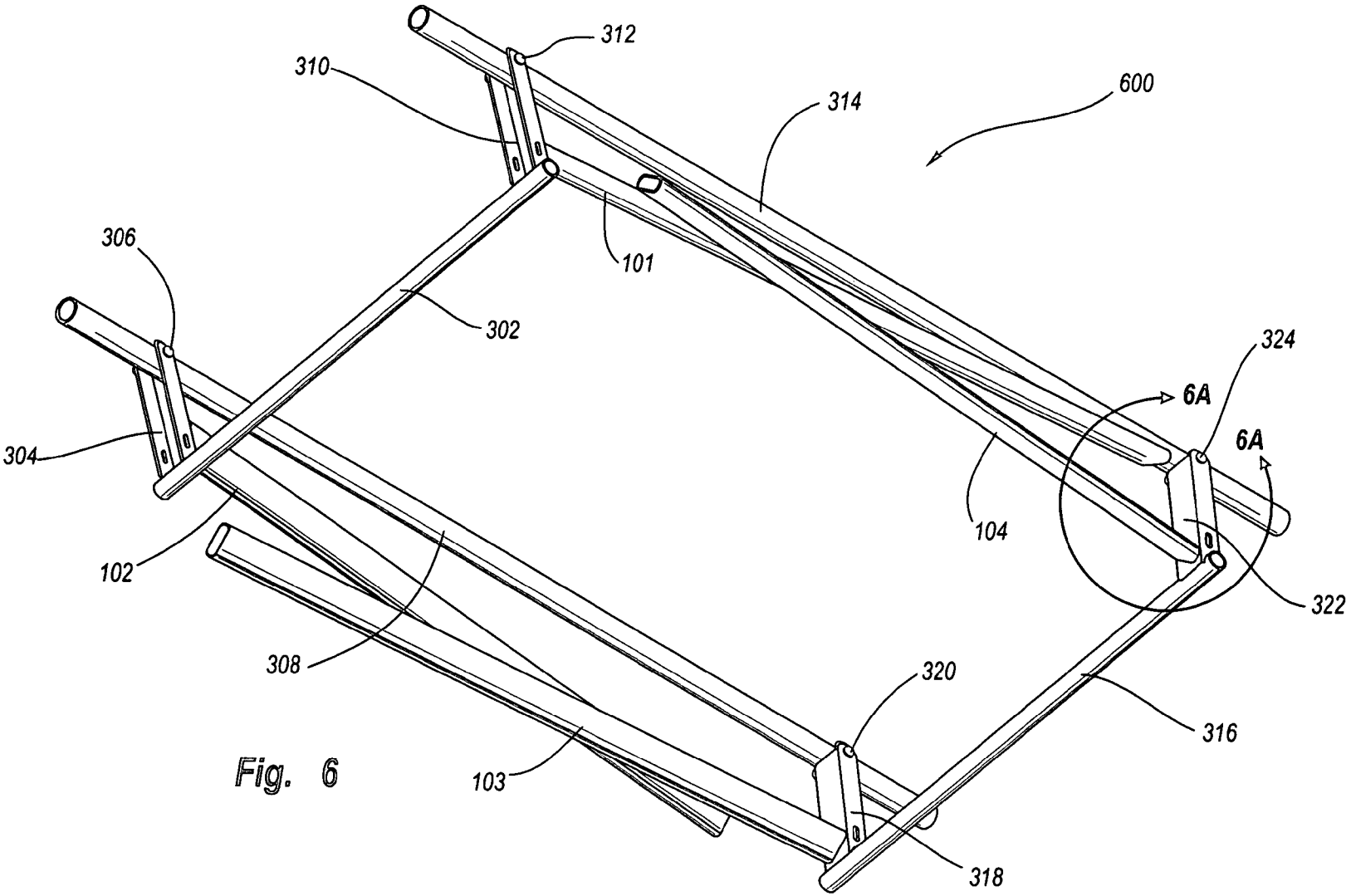
FIG. 6 is a bottom perspective view of a portion of the table shown in FIG. 1, illustrating the frame and the legs in the collapsed position.

An exemplary embodiment of a frame that may be used in conjunction with the table 100 is shown in FIG. 6. The frame 600 may include one or more of the following: one or more bracket members (e.g., bracket members 304, 310, 318, and 322), one or more legs (e.g., legs 101, 102, 103, and 104), one or more elongated members (e.g., side rails 308 and 314), and one or more cross members (e.g., crossbar 302 and 316). The frame 600 may be attached to the table or table top by any suitable manner such as fasteners or adhesives. The frame 600 may also be attached to the table or table top by one or more brackets or the like. In addition, all or a portion of the frame 600 may be attached to the table or table top by a snap, friction or interference fit, if desired. Advantageously, the frame 600 may be used to create a strong and lightweight table.

Figure 6B:
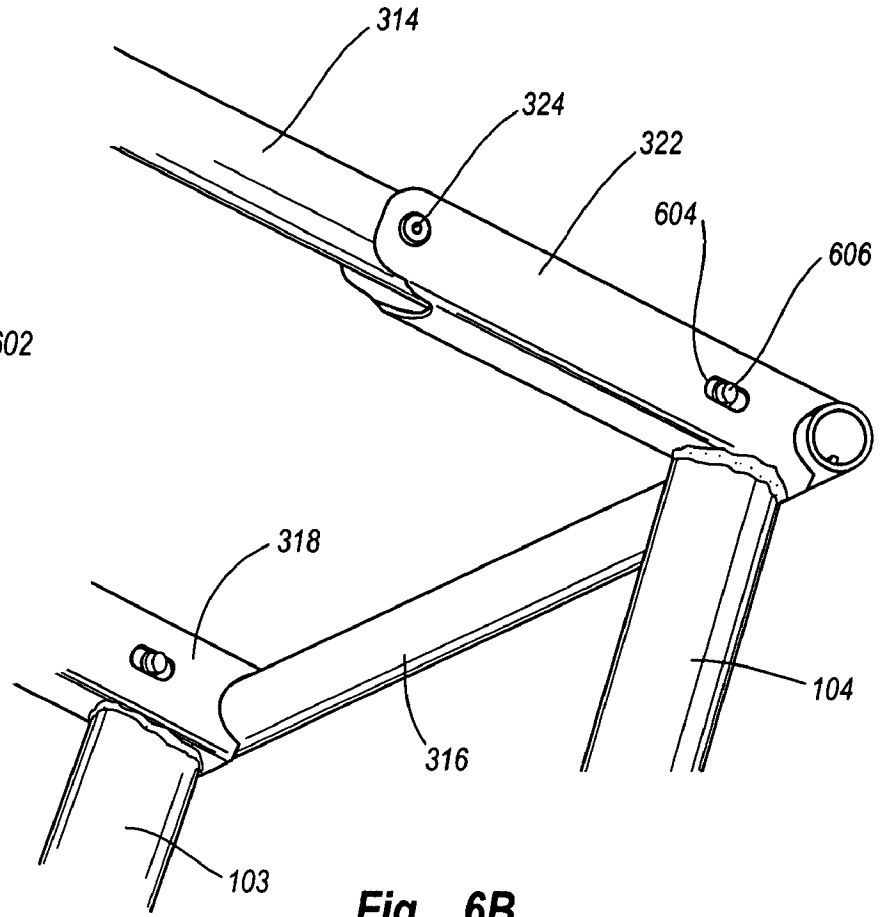
FIG. 6B is an enlarged bottom perspective view of a portion of the frame and legs shown in FIG. 6, illustrating the legs in the extended position.
Figure 6A:
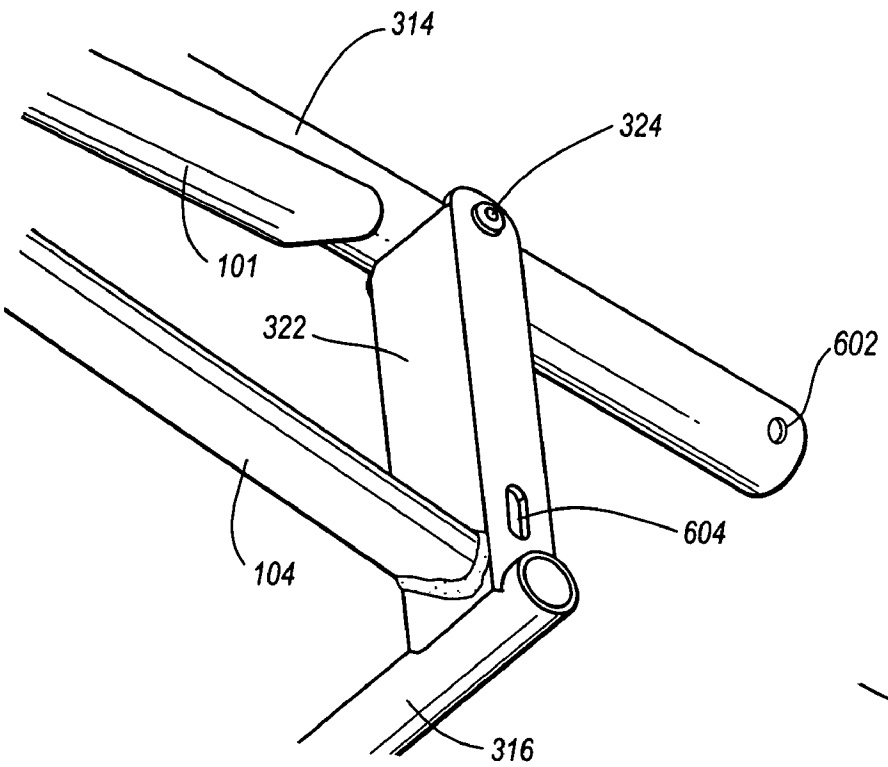
FIG. 6A is an enlarged bottom perspective view of a portion of the frame and legs shown in FIG. 6, illustrating the legs in the collapsed position.

In greater detail, as seen in FIGS. 6A and 6B, the legs may be attached to the frame 600. For example, the leg 104 may be attached to the bracket 322 and the bracket is pivotally attached to the side rail 314 of the frame 600. As discussed above, the bracket 322 may be connected to bracket 318 by the crossbar 316. The bracket 322 is preferably pivotally attached to the side rail 314 at a distance away from the end of the side rail. In particular, the bracket 322 preferably has a length and the bracket is preferably attached that same length away from the end of the side rail 314. Thus, when the bracket 322 is generally aligned and parallel with the side rail 314, the end of the bracket is generally aligned with the end of the side rail. It will be appreciated, however, that the bracket 322 could be attached to any suitable portion of the side rail 314.

As shown in FIGS. 6A and 6B, the end of the side rail 314 may include an opening 602 and the bracket 322 may include a corresponding slot 604. As shown in FIG. 6A, when the bracket 322 is at an angle relative to the side rail 314, the slot 604 is spaced apart from the opening 602. However, as shown in FIG. 6B, when the bracket 322 is generally aligned and parallel to the side rail 314, then the opening 602 and the slot 604 are preferably aligned. This may allow the bracket 322 and corresponding leg 104 to be secured in the extended position.

For example, as shown in FIG. 6B, at least a portion of a locking pin 606 may be inserted into both the opening 602 and the slot 604 to lock the bracket 322 in a secured position relative to the side rail 314. It will be appreciated that other structures or devices, such as screws or bolts, may also be inserted into the opening 602 and slot 604 to secure the bracket 322 in a fixed position. In addition, it will be appreciated that a detent, snap, friction, interference or other type of connection may also be used to secure the bracket 322 in a fixed position. One skilled in the art will also appreciate that clips or brackets may also be used to secure the bracket 322 in a fixed position.

As shown in FIG. 6A, when the bracket 322 is at an angle of about ninety degrees with respect to the side rail 314, the leg 104 and cross bar 316 are spaced apart from the side rail. If the leg 104 is attached at about a ninety degree angle with respect to the bracket 322, when the bracket is at ninety degree angle with respect to the side rail 316, the leg is generally spaced apart and parallel to the side rail. In particular, the leg 104 is spaced at a generally uniform distance from the side rail 316 and that distance is approximately equal to the length of the bracket 322. Advantageously, as shown in FIG. 5, this allows the leg 104 to be folded around the drawer 106 when the leg is in the collapsed position. Similarly, the legs 101, 102, 103 can also be folded around the drawer 106 in the collapsed position.

Figure 7:
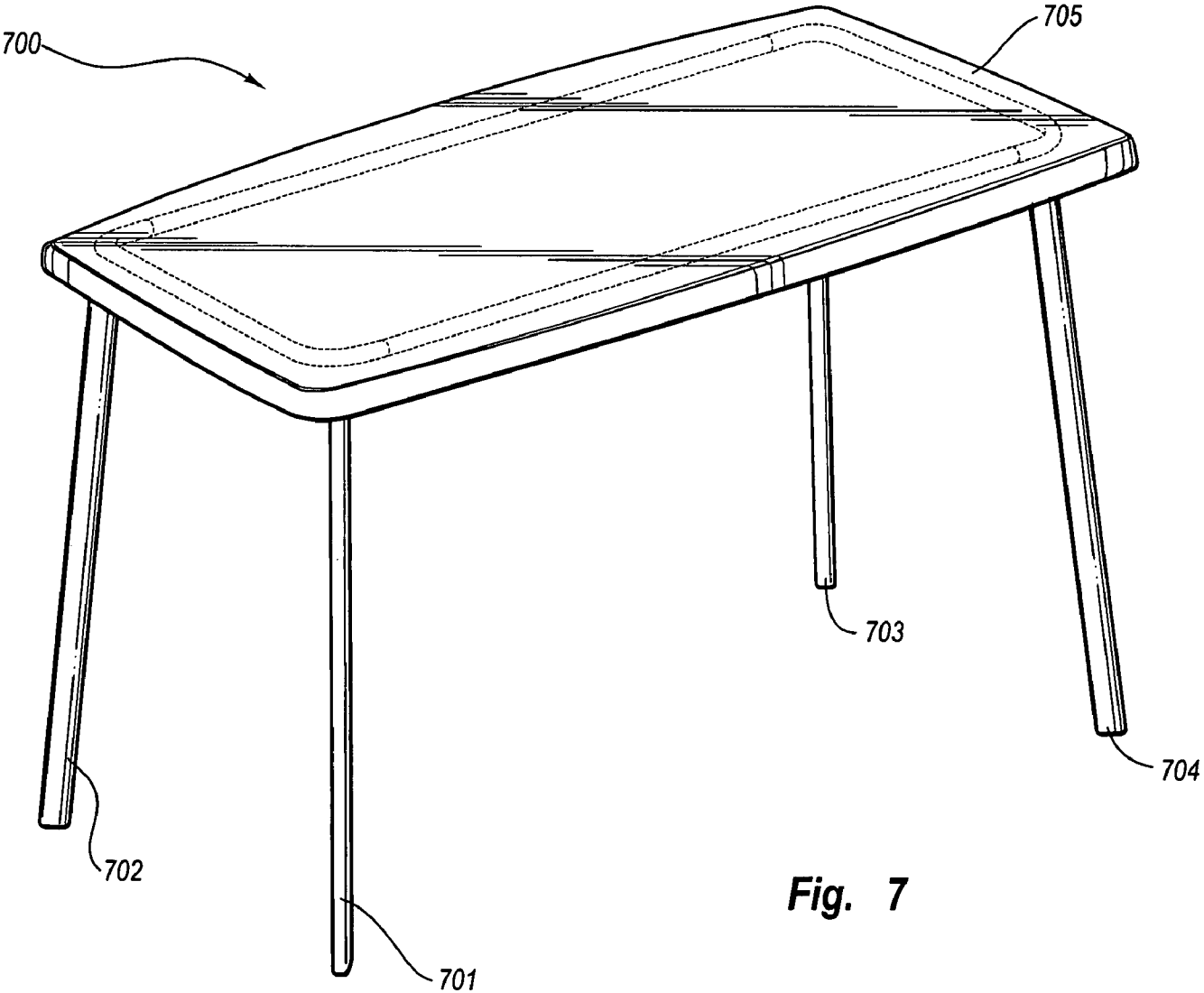
FIG. 7 is a top perspective view of another exemplary embodiment of a table.

The table can include other suitable types and configurations of structures that may be used to support the table top. For example, as shown in FIG. 7, an exemplary embodiment of a table 700 includes legs 701, 702, 703, 704 and a table top 705. The table top 705 is preferably constructed from blow-molded plastic, but any suitable material, including but not limited to plastic, metal, wood, or the like, may be used to make the table top. The legs 701, 702, 703, 704 may be constructed metal and, in particular, from hollow metal tubes, but the legs can be made from any suitable materials, including but not limited to plastic, wood, or the like, and the legs can have any desirable configuration. The table 700 may also include one or more drawers (not pictured) and the drawers may be attached to the table top, legs, a frame, or any other suitable component of the table.

Figure 8:
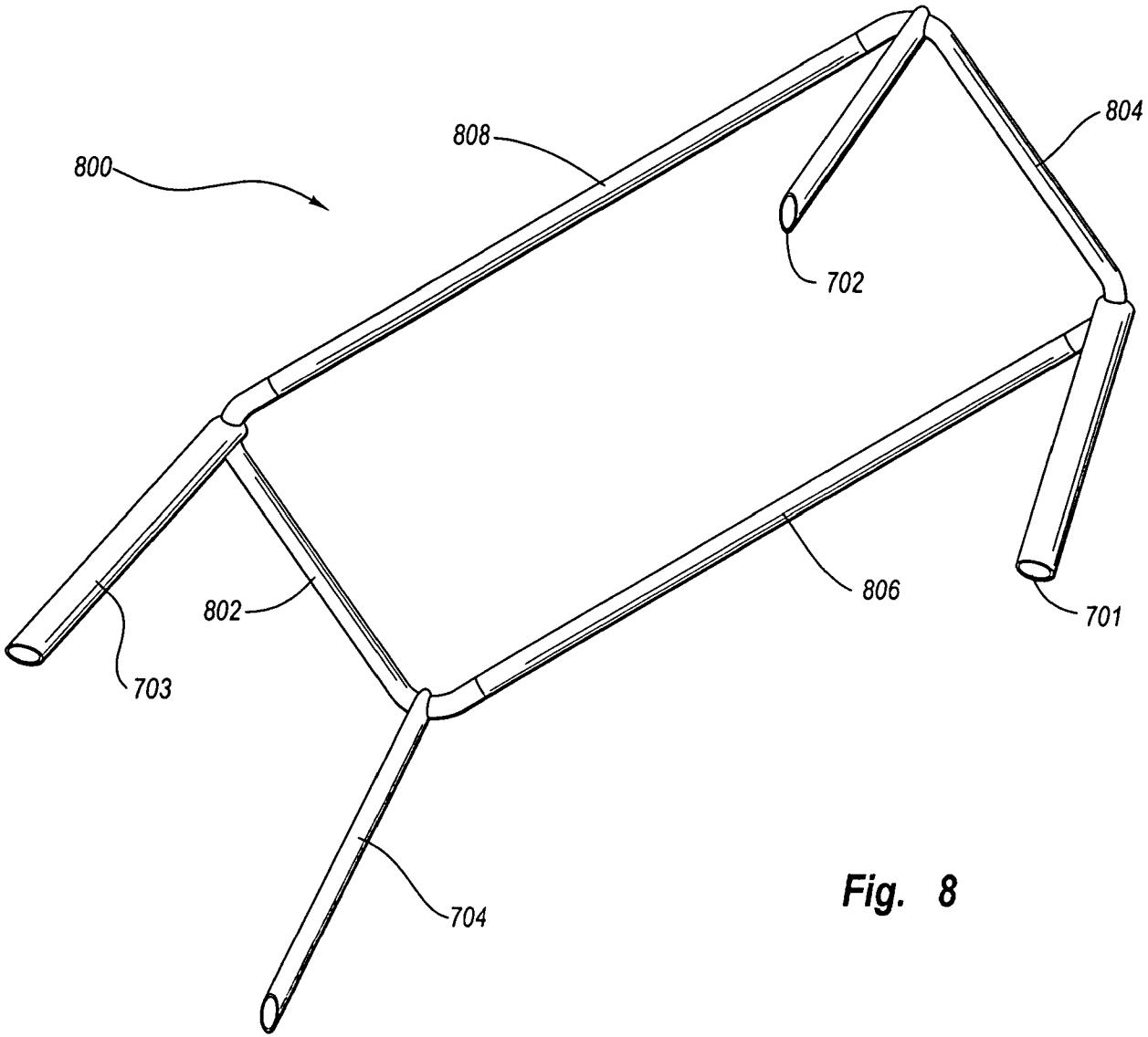
FIG. 8 is a bottom perspective view of a portion of the table shown in FIG. 7, illustrating the frame and legs.

As shown in FIG. 8, the table 700 preferably includes a frame 800 that is used to support the table top. The frame 800 may include two crossbars or cross members 802, 804 and two elongated members or side rails 806, 808. The cross bars 802, 804 and side rails 806, 808 are preferably attached to form at least a portion of the frame 800. The legs 701, 702, 703, 704 may be attached to the crossbars 802, 804, but the legs could also be attached to the side rails 806, 808. The crossbars 802, 804 and side rails 806, 808 may be constructed from hollow metal tubes with a generally circular cross sectional configuration to form a relatively strong and secure frame 800. One skilled in the art will appreciate that the legs 101, 102, 103, 104, cross bars 802, 804, and side rails 806, 808 may be formed using any suitable manner, using any suitable number of components or subcomponents, and using one or more of any suitable materials, including but not limited to plastic, metal, wood, or the like. In addition, these components could have any suitable size and shape depending, for example, upon the intended use of the frame 800.

Figure 9:
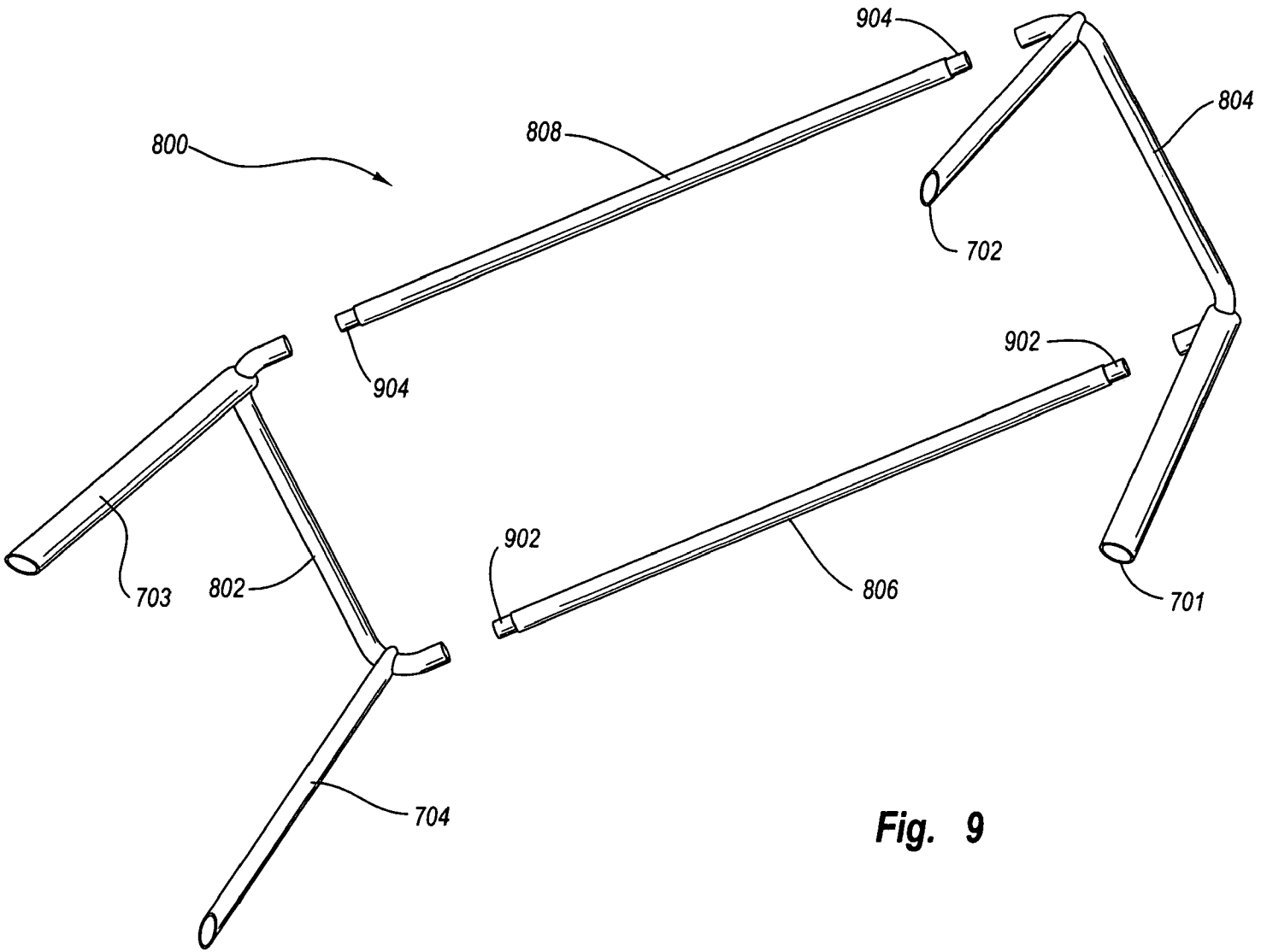
FIG. 9 is an exploded bottom perspective view of the portion of the table shown in FIG. 7, illustrating the legs disconnected from the frame.

As shown in FIG. 9, the crossbars 802, 804 and the side rails 806, 808 of the frame 800 are preferably slidably connected. In particular, the side rail 806 preferably includes ends 902 that are sized to fit within a portion of the crossbar 802 and a portion of the crossbar 804. Similarly, the side rail 808 includes ends 904 that are sized to fit within a portion of the crossbar 802 and a portion of the crossbar 804. In one embodiment, the ends 902 and 904 are sized to create a friction, snap or interference fit when inserted within a portion of the crossbars 802 and 804. Advantageously, this allows the frame 800 to be easily assembled and disassembled. In addition, this may allow the crossbars 802, 804 and legs 701, 702, 703, 704 to be quickly and easily disconnected from the table, which may allow the table to be easily ship and transported. This may also allow the table to be conveniently stored when not in use. The frame 800 may also have other suitable configurations depending, for example, upon the intended use of the table. It will be understood that any suitable manner of assembling the frame 800 may be used, including not limited to welding, gluing, bolting, screwing, or the like.

Figure 10:
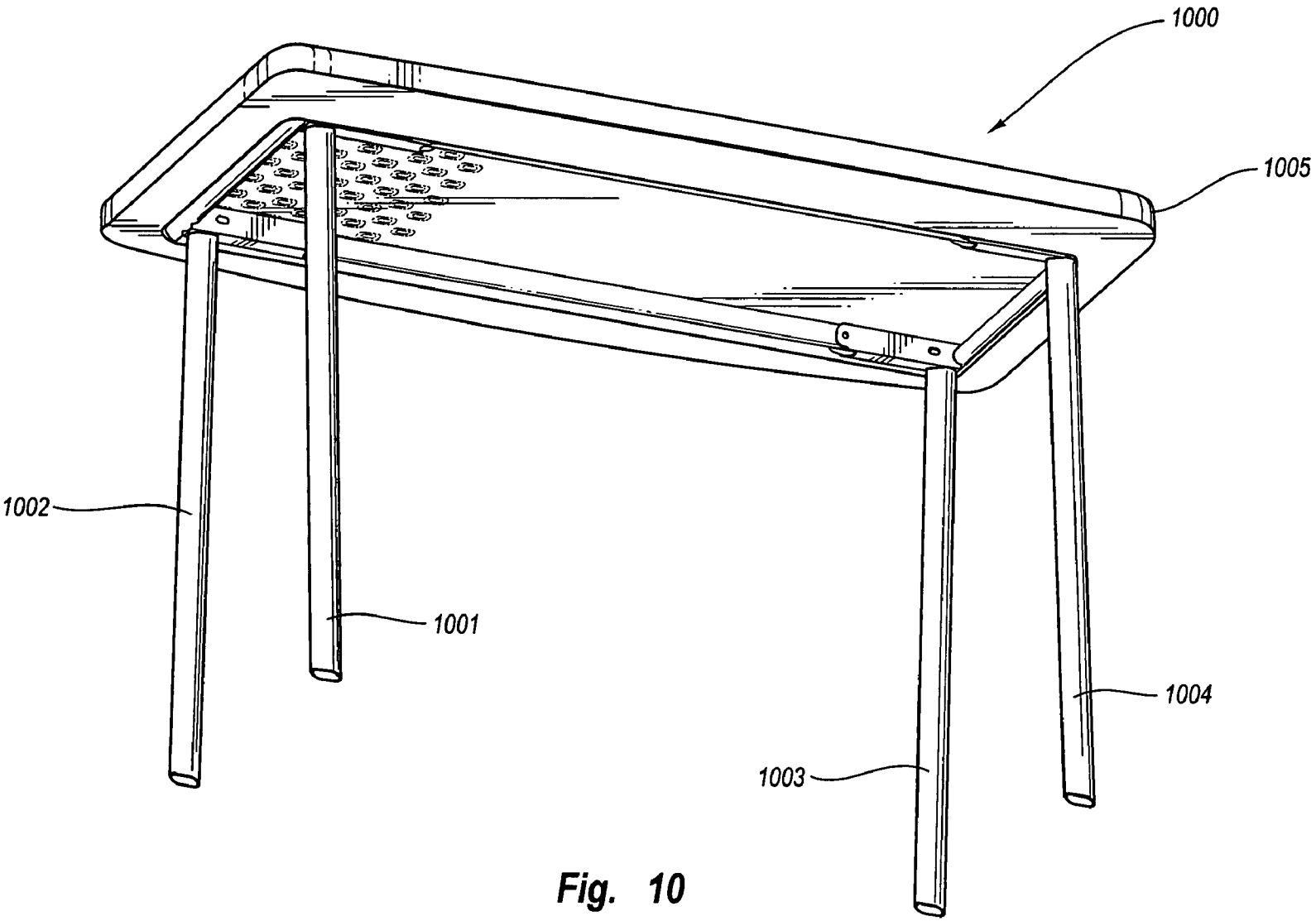
FIG. 10 is a bottom perspective view of yet another exemplary embodiment of a table.
Figure 11:
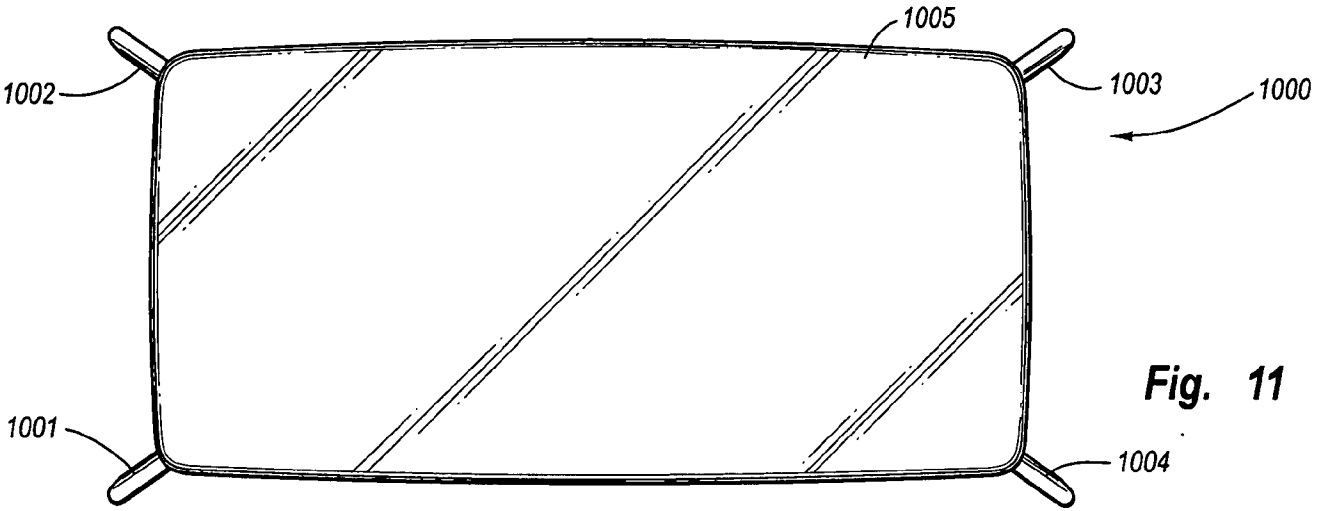
FIG. 11 is a top view of the table shown in FIG. 10.

As shown in FIG. 10, the table 1000 does not have to include a drawer. For example, the table 1000 may include legs 1001, 1002, 1003, 1004 and a table top 1005. As discussed above, the table top 1005 may be constructed from blow-molded plastic or any suitable material, including but not limited to plastic, metal, wood, or the like. In addition, the legs 1001, 1002, 1003, and 1004 may be made metal or any suitable material, including but not limited to plastic, wood, or the like.

The table 1000 may include a frame similar to the frame 600 that was previously discussed. For example, the table 1000 may include a crossbar or cross member 1202 that is attached to a bracket 1204 and a leg 1002 may be attached to the bracket. The bracket 1204 may be coupled at a location 1206 to an elongated support member such as a side rail 1208. The crossbar 1202 may also be attached to a bracket 1210 and a leg 1001 may be attached to the bracket. The bracket member 1210 may be coupled at location a 1212 to an elongated support member such as a side rail 1214. A crossbar or cross member 1216 may be attached to a bracket member 1218 and a leg 1003 may be attached to the bracket. The bracket 1218 may be coupled at a location 1220 to the side rail 1208. The crossbar 1216 may also be attached to a bracket 1222 and a leg 1004 may be attached to the bracket. The bracket member 1222 may be coupled at a location 1224 to the side rail 1214. Advantageously, the brackets 1204, 1210, 1218, 1222 may be pivotally coupled to the frame to allow the legs to be moved between an extended position and a collapsed position. In addition, the legs 1001, 1002, 1003, 1004 may be pivotally to the brackets 1204, 1210, 1218, 1222, if desired, to allow the legs to be moved between the extended and collapsed positions. The legs 1001, 1002, 1003, 1004; brackets 1204, 1210, 1218, 1222; and side rails 1208, 1214, however, do not have to be pivotally connected and the legs could be held in a fixed location if desired.

In addition, the legs 1001, 1002, 1003, 1004 and brackets 1204, 1210, 1218, 1222 may be formed as single members or integral components. For example, the leg 1002 and the bracket 1204 member may be formed as a single member or integral component, which may be attached to the crossbar 1202. In addition, the crossbar 1202 could be part of a single component with the leg 1001 and bracket 1204 if desired. Further, the legs 1001, 1002; brackets 1204, 1210; and crossbar 1202 could be formed as a single member or component if desired. The various items could also be separate components that are interconnected by any suitable manner such as fasteners, adhesives, welding, and the like. In addition, these items may be formed in any suitable manner, using any suitable number of components or sub-components, and using one or more of any suitable types of materials, including but not limited to plastic, metal, wood, or the like. For example, while the legs 1001, 1002, 1003, 1004; crossbars 1202, 1216; and side rails 1208, 1214 may be constructed from hollow metal tubes with generally circular or oval cross-sections, these components could also be made of solid materials, have other suitable shapes and sizes, and be formed from any materials with appropriate characteristics.

Figure 13:
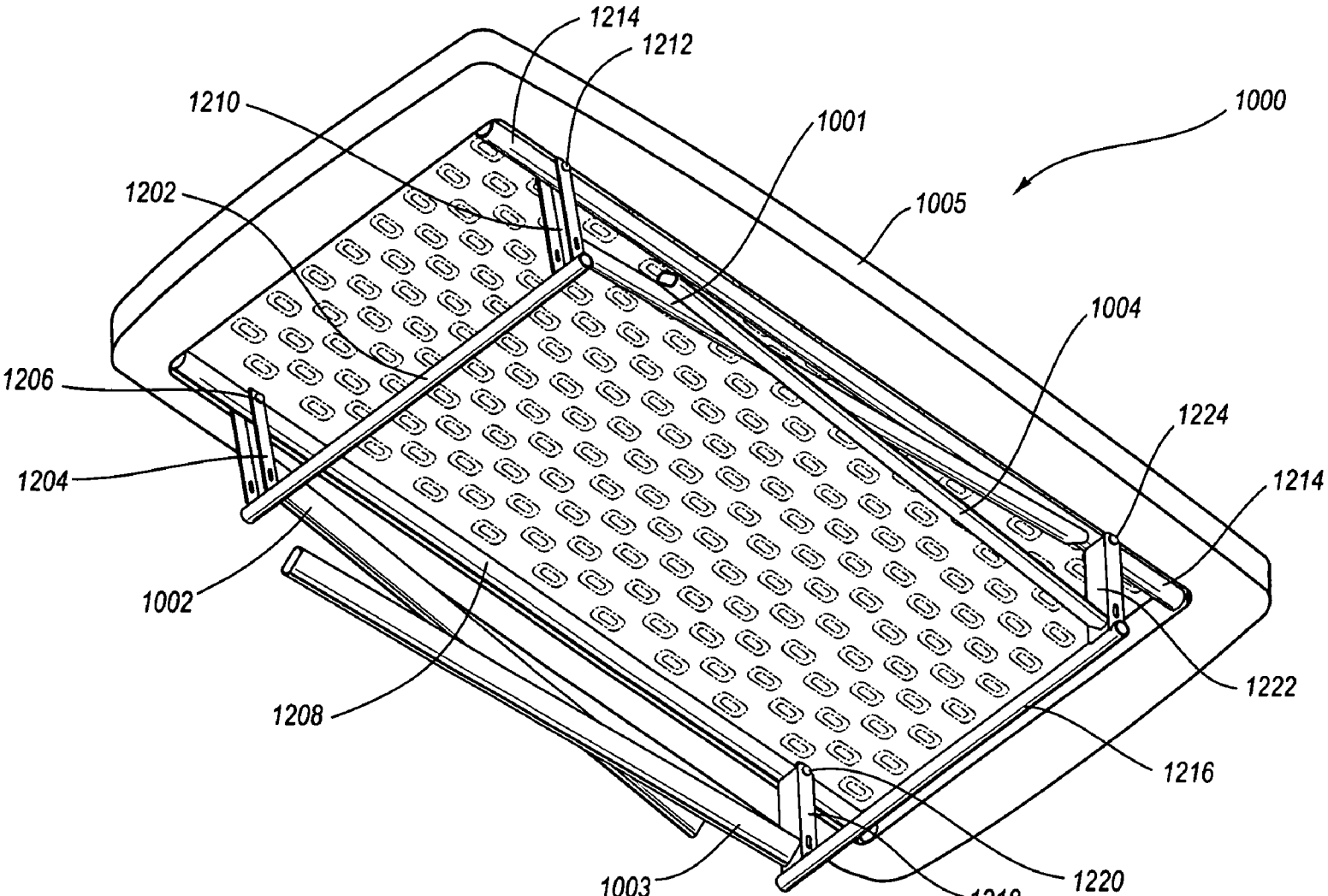
FIG. 13 is a bottom perspective view of the table shown in FIG. 10, illustrating the legs in a collapsed position.

As shown in FIG. 13, the brackets 1204, 1210, 1218, 1222 may have a variety of suitable shapes and configurations. For example, brackets 1204 and 1210 illustrate that the brackets may simply consist of a pair of elongated members. On the other hand, the brackets 1218, 1222 illustrate that the brackets may have other suitable configurations. In addition, the legs may be attached to the brackets at any suitable angle. For example, the legs could be attached at about a ninety degree angle so that the legs could be disposed around a drawer. The legs could also be located at a different angle so that the legs are either disposed towards the table top or away from the table top depending, for example, upon the intended use of the table.

As shown in FIG. 13, the brackets 1204, 1210, 1218, 1222 and legs 1001, 1002, 1003, 1004 may allow the table to be positioned at a different height. For example, when the legs are in the collapsed position, the table top may be supported by the brackets 1204, 1210, 1218, 1222 and/or the crossbars 1202, 1216. In this configuration, the table 1000 may be used to support items slightly above a surface such as a floor. One skilled in the art will understand that the height of the table top above the floor may be dependent upon the length of the brackets 1204, 1210, 1218, 1222.

Figure 12:
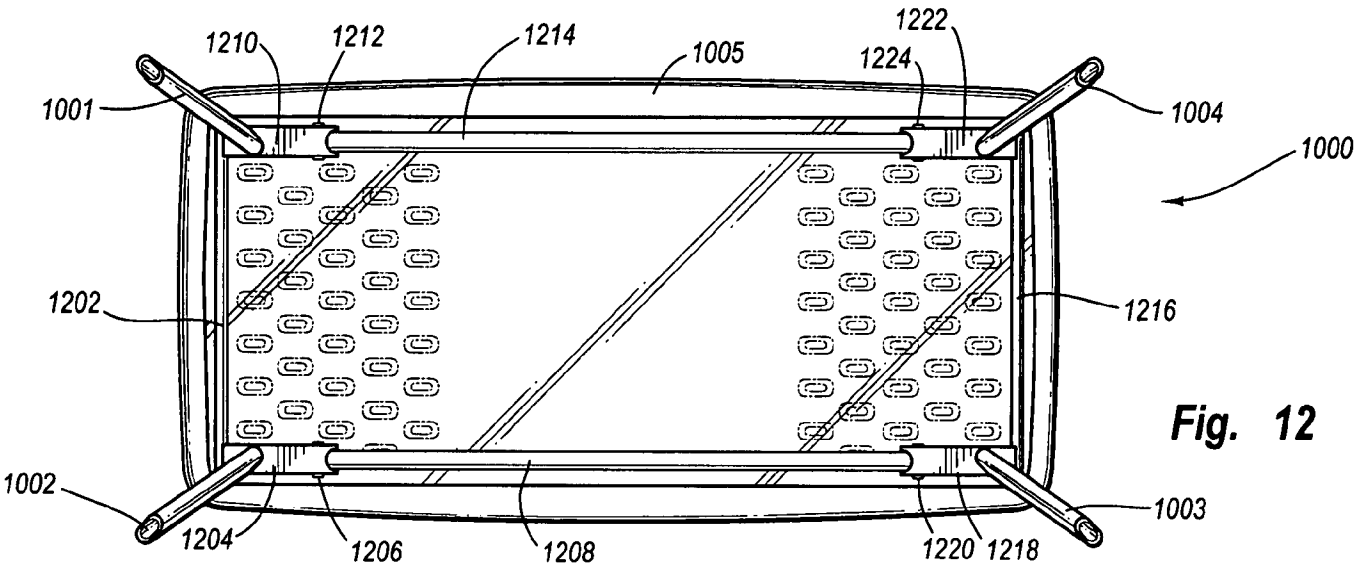
FIG. 12 is a bottom view of the table shown in FIG. 10.

As shown in FIG. 12, when the legs 1001, 1002, 1003, 1004 are in the extended position, the legs are preferably disposed towards the outer portions of the table top. The legs 1001, 1002, 1003, 1004 could also be disposed inwardly from the outer portions of the table top if desired. In order to prevent the legs 1001, 1002, 1003, 1004 from touching or interfering with each other when the legs are in the collapsed position, the legs could be offset from each other. For example, the brackets 1204, 1210, 1218, 1222 could have different heights and/or the legs could be attached to different portions of the brackets so that the legs can be quickly and easily moved into the collapsed position with interfering or contacting each other. One skilled in the art will understand that the legs and/or brackets may have various configurations and arrangements to prevent the legs from contacting or interfering with each other when the legs are in the collapsed position.

Figure 14:
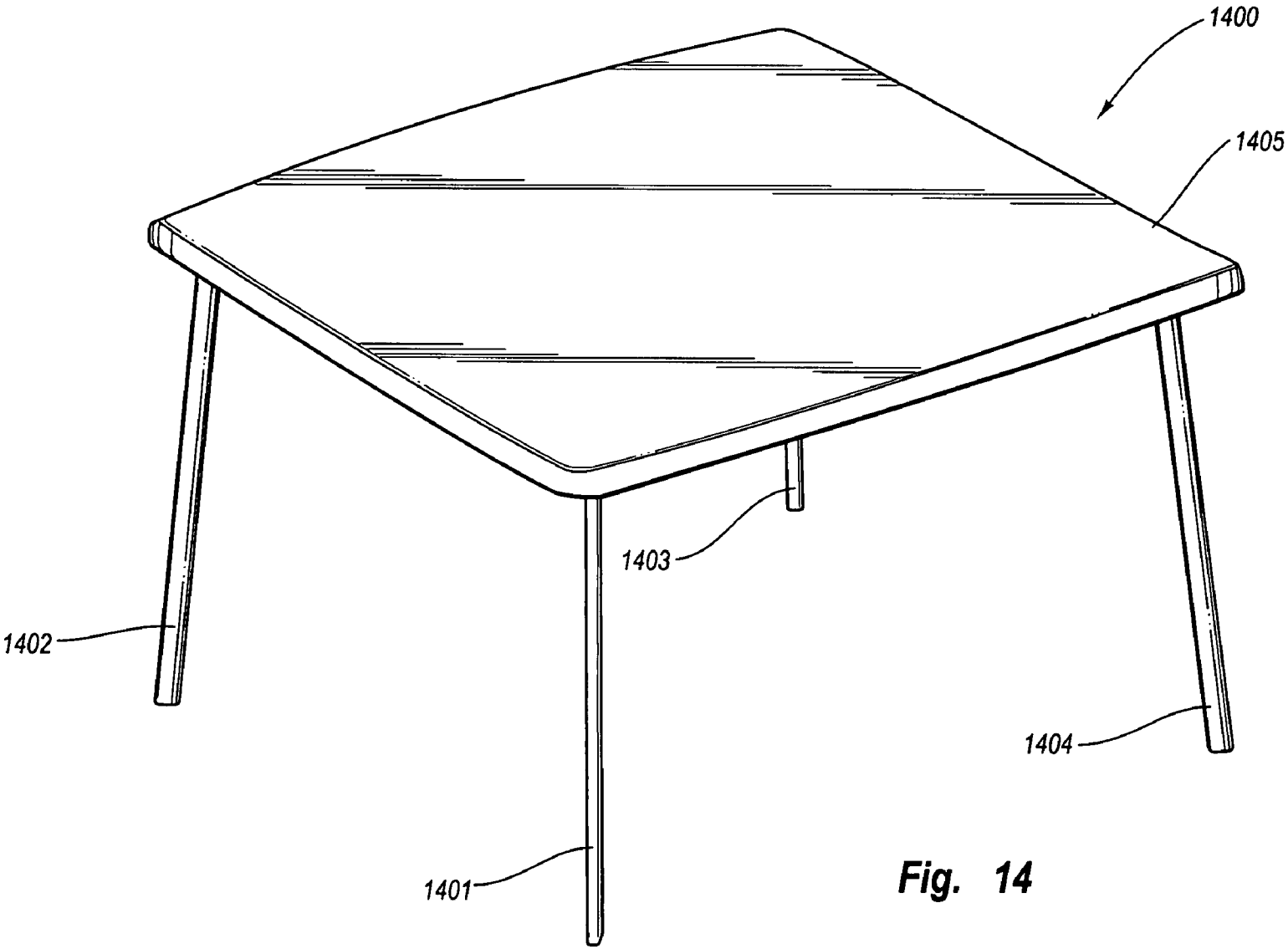
FIG. 14 is a top perspective view of still another exemplary embodiment of a table.

As discussed above, the table may have a variety of suitable shapes and configurations. For example, as shown in FIG. 14, the table 1400 may include legs 1401, 1402, 1403, 1404 and a table top 1405. The table top 1405 may have a square configuration and it may be sized to allow four people to use the table at one time. The table top 1405 may advantageously made of blow-molded plastic, but other suitable materials and processes may be used to construct the table top. It will be understood that the table top 1405 may have any suitable shape or size. For example, the table top 1405 may be round, elliptical, rectangular, or the like.

Figure 15:
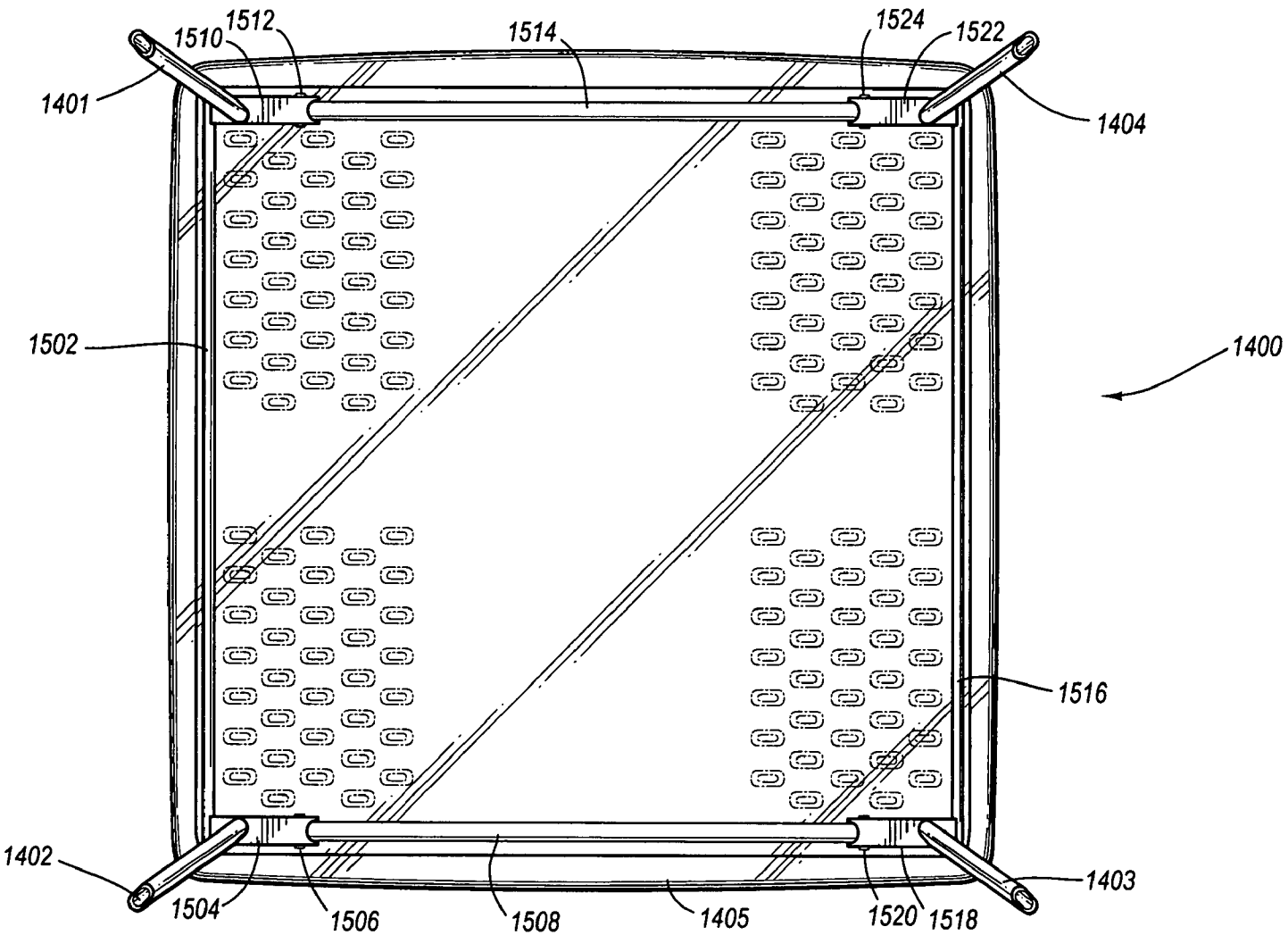
FIG. 15 is a bottom view of the table shown in FIG. 14.

As shown in FIG. 15, the table 1400 may include a frame with a crossbar 1502, side rail 1508, crossbar 1516 and side rail 1514. If desired, these components may be interconnected to form the frame. The table 1400 may also include brackets 1504, 1518 that are attached to the side rail 1508 and brackets 1510, 1522 that are attached to the side rail 1514. The legs 1401, 1402, 1403, 1404 are preferably attached to the brackets 1504, 1510, 1518, 1522, respectively, and the brackets are preferably pivotally connected to the side rails at locations 1506, 1512, 1520, 1524. Thus, as described above, the legs 1401, 1402, 1403, 1404 may be moved between a first position and a second position. In addition, the legs 1401, 1402 may be interconnected by the crossbar 1502 and the legs 1403, 1404 may be interconnected by the crossbar 1516. Advantageously, this may allow two legs to be simultaneously moved between the extended and collapsed positions. The legs, however, could be independently attached to the frame. In addition, the legs could be attached to any suitable portions of the table top or frame.

The brackets 1504, 1510, 1518, 1522 may pivot in a manner substantially similar to the brackets described above. In addition, as discussed above, the legs and brackets may be pivotally or securely connected. Further, the legs, brackets and/or cross bars may be formed as a single member or separate components that are interconnected. Of course, the brackets, legs, crossbars, and side rails may be constructed from any materials with suitable characteristics and formed by any suitable manner. The brackets, legs, crossbars, and side rails may also have any suitable arrangement and configuration depending, for example, upon the intended use of the table.

Figure 16:
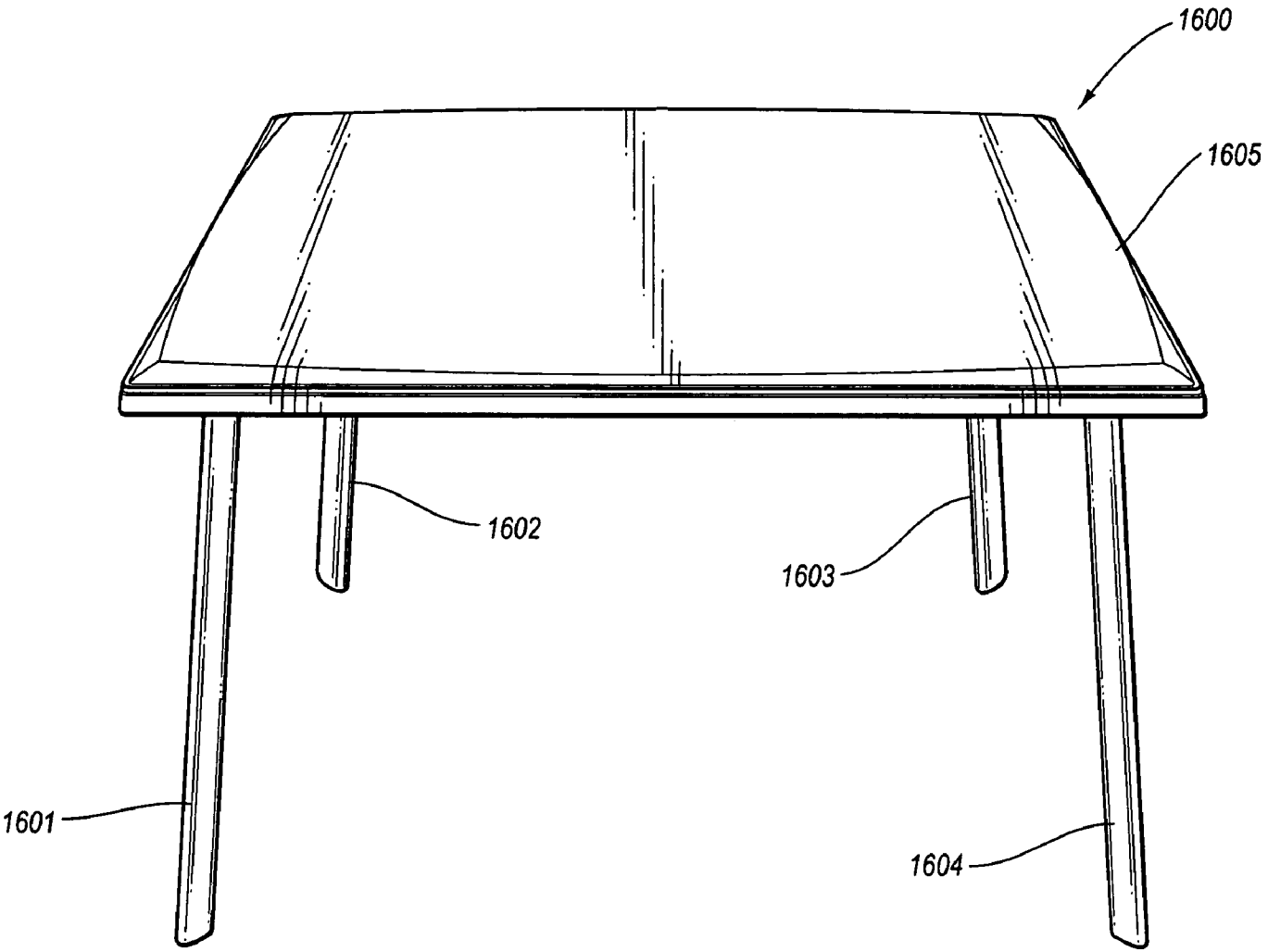
FIG. 16 is a top perspective view of a further exemplary embodiment of a table.
Figure 17:
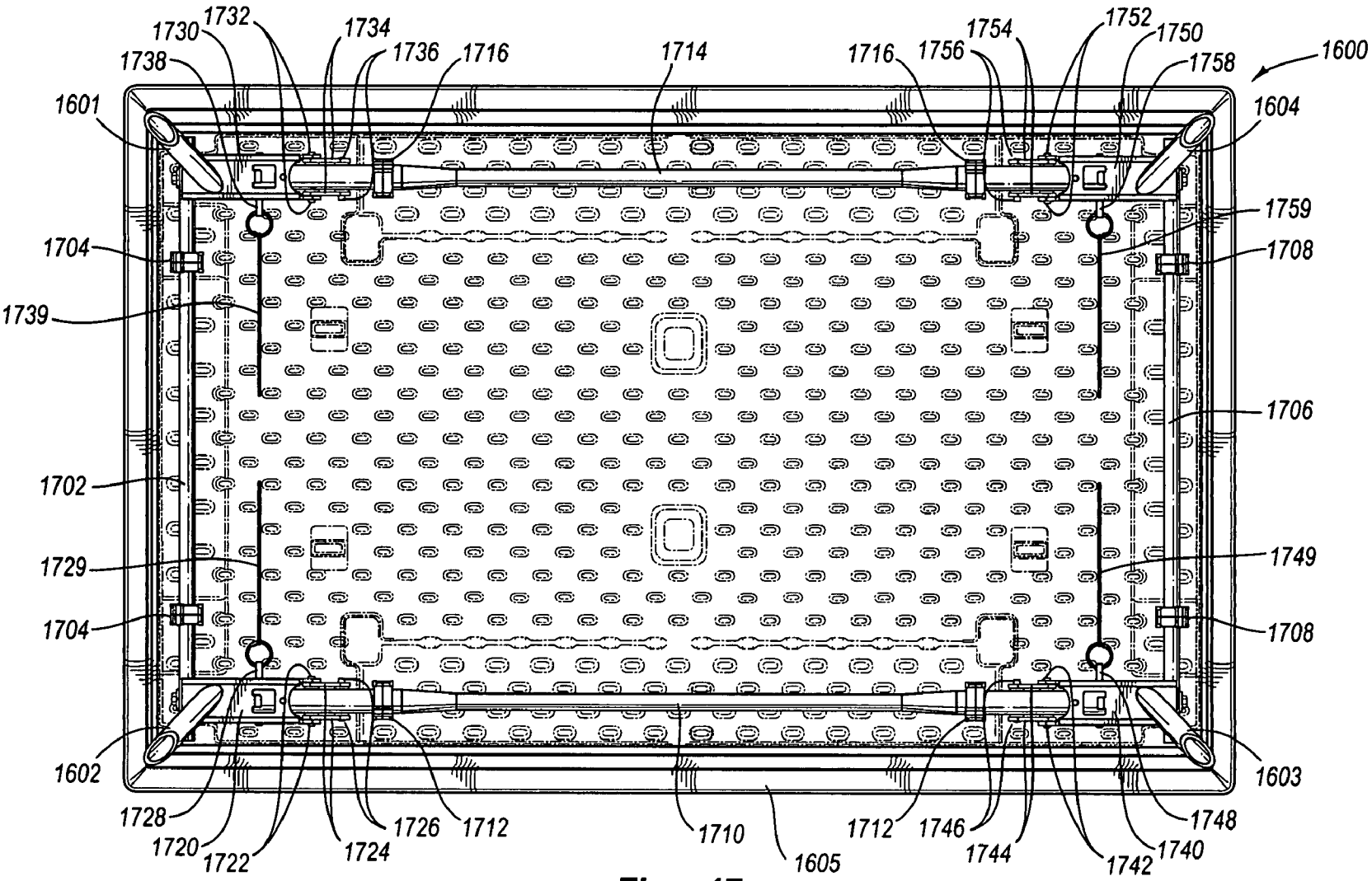
FIG. 17 is a bottom view of a still further exemplary embodiment of a table.

Another exemplary embodiment of the table is shown in FIG. 16. The table 1600 includes legs 1601, 1602, 1603, 1604 and a table top 1605. As discussed above, the table top 1605 may be constructed from blow-molded plastic and the legs 1601, 1602, 1603, 1604 may be constructed from metal, but any suitable materials may be used to construct the table 1600. As shown in FIG. 17, a crossbar or cross member 1702 may be attached to one side of the table top 1605 by one or more clips 1704. Another crossbar or cross member 1706 may be attached to the other side of the table top 1605 by one or more clips 1708. The clips 1704, 1706 may securely or removably attached the cross bars 1704, 1706 to the table top 1605. The clips 1704, 1706 may also rotatably or non-rotatably connect the cross bars 1704, 1706 to the table top. The table 1600 may also include an elongated support member or side rail 1710 that is attached to one side of the table top 1605 by one or more clips 1712, and another side rail 1714 that is attached to another side of the table top by one or more clips 1716. The clips 1712, 1716 preferably rotatably connect the side rails 1710, 1714 to the table top 1705.

As illustrated in FIG. 17, the bracket 1720 is coupled to a pair of links 1724 by one or more fasteners 1722 and the links are coupled to the side rail 1710 by one or more fasteners 1726. A locking pin 1728 is advantageously inserted into an opening in the bracket 1720 and into an opening in the side rail 1710 to secure the bracket in a fixed position. This may secure the leg 1602 in an extended position. A leash 1729 may be coupled to the locking pin 1728 and that leash may be coupled to the table top 1605 and the leash may be configured to facilitate insertion and retraction of the pin from the openings.

Similarly, a second bracket 1730 may be coupled by a pair of links 1734 to the side rail 1714 and a locking pin 1738 may be inserted into an opening in the bracket and into an opening in the side rail to secure the bracket in a fixed position. A leash 1739 may be coupled to the locking pin 1738 and it may be coupled to the table top 1605. In addition, a third bracket 1740 may be coupled by a pair of links 1744 to the side rail 1710 and a locking pin 1748 may be inserted into an opening in the bracket and into an opening in the side rail to secure the bracket in a fixed position. A leash 1749 may be coupled to the locking pin 1748 and it may be coupled to the table top 1605. Further, a forth bracket member 1750 may be coupled by a pair of links 1754 to the side rail 1714 and a locking pin 1758 may be inserted into an opening in the bracket and into an opening in the side rail to secure the bracket in a fixed position. A leash 1759 may be coupled to the locking pin 1758 and it may be coupled to the table top 1605.

Figure 18:
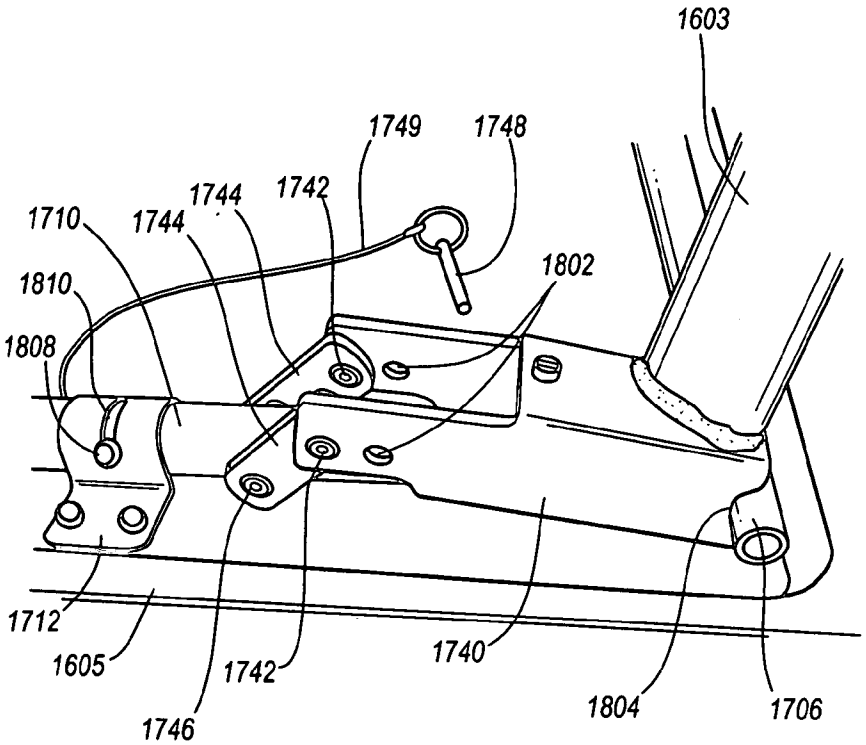
FIG. 18 is an enlarged bottom perspective view of a portion of the table shown in FIG. 17, illustrating the leg, a connecting link and a securing pin.

As illustrated in FIG. 18, the locking pin 1748, which had been inserted through a pair of openings 1802 in the bracket member 1740 and through a pair of openings in the bar member 1710, has been removed. Accordingly, by moving the leg 1603 and/or bracket 1740, the bracket and the links 1744 have moved from a position that was substantially parallel to the table top 1605 to an angled or nonparallel position in which a portion of an edge 1804 of the bracket 1740 does not engage the crossbar 1706. Thus, the leg 1603 can be moved between an extended position and a collapsed position. One skilled in the art will understand that the leg 1603 and bracket 1740 can be secured in a fixed position by other suitable methods or devices. For example, the leg 1603 and/or bracket 1740 can be secured in a fixed position by one or more pins, detents, fasteners and the like. The leg 1603 and/or bracket 1740 may also be secured in a fixed position, for example, by a friction, snap or interference fit. In addition, one or more locking pins may be used to secure the leg 1603 and/or bracket 1740 in a fixed position.

The bracket 1740 may be coupled to the links 1744 using rivets or any other suitable coupling device, including but not limited to fasteners, bolts, or the like. The links 1744 are coupled to the side rail 1710 using rivets or any other suitable coupling device, including but not limited to fasteners, bolts, or the like.

As illustrated in FIG. 18, the clip 1712 is secured to the table top 1605 using any suitable means, including a bolt, a screw, adhesive, a rivet, a nail, a weld, or the like. The clip 1712 preferably rotatably connects the side rail 1710 to the table top. In addition, the clip 1712 and the side rail 1710 may each include corresponding features, such as a groove, a slot, or the like that is adapted to engage a pin, a protrusion, or the like. In one embodiment, the clip 1712 includes a slot 1810 and the bar member 1710 includes a protrusion 1808 adapted to be inserted through the slot 1810. In one embodiment, the slot 1810 and the protrusion 1808 hinder the movement of the bar member 1710 along the longitudinal axis of the side rail 1710, but allow rotation of the side rail 1710 relative to the table top.

Figure 19:
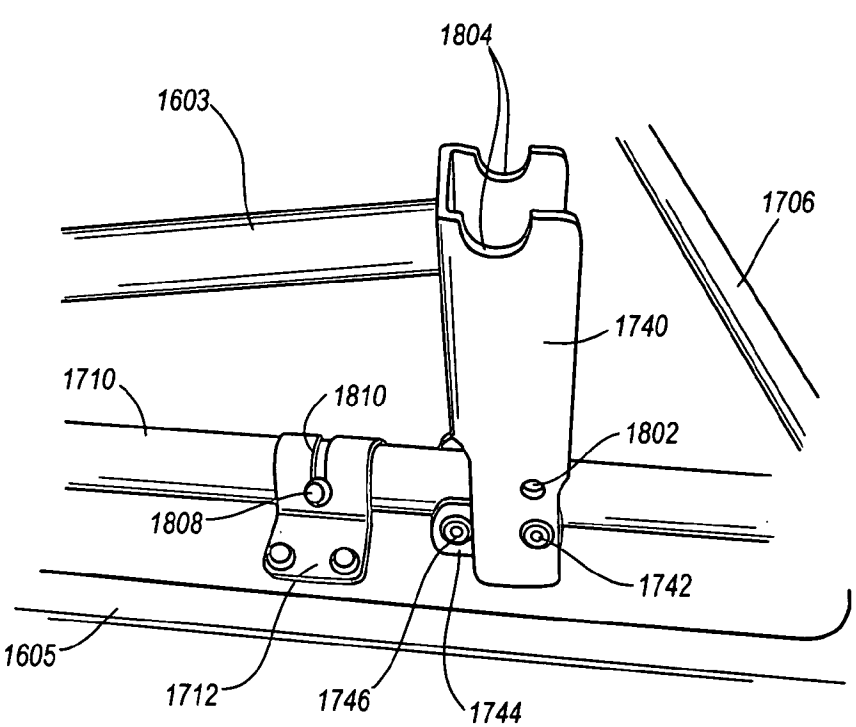
FIG. 19 is another enlarged bottom perspective view of a portion of the table shown in FIG. 17, illustrating the leg in a collapsed position.

As illustrated in FIG. 19, the links 1744 and the bracket 1740 allow the leg 1603 to be moved between an extended position and a collapsed position. For example, the links 1744 may allow the bracket 1740 to be moved out of engagement with the crossbar 1706. The links 1744 may also allow the bracket 1740 to be moved so that it is generally perpendicular to the side rail 1710. As shown in FIG. 19, when the leg 1603 is in the collapsed position, the links 1744 may be positioned generally parallel to the side rail 1710. On the other hand, the links 1744 could be positioned at an angle relative to the side rail 1710 such as a ninety degree angle.

Figure 20:
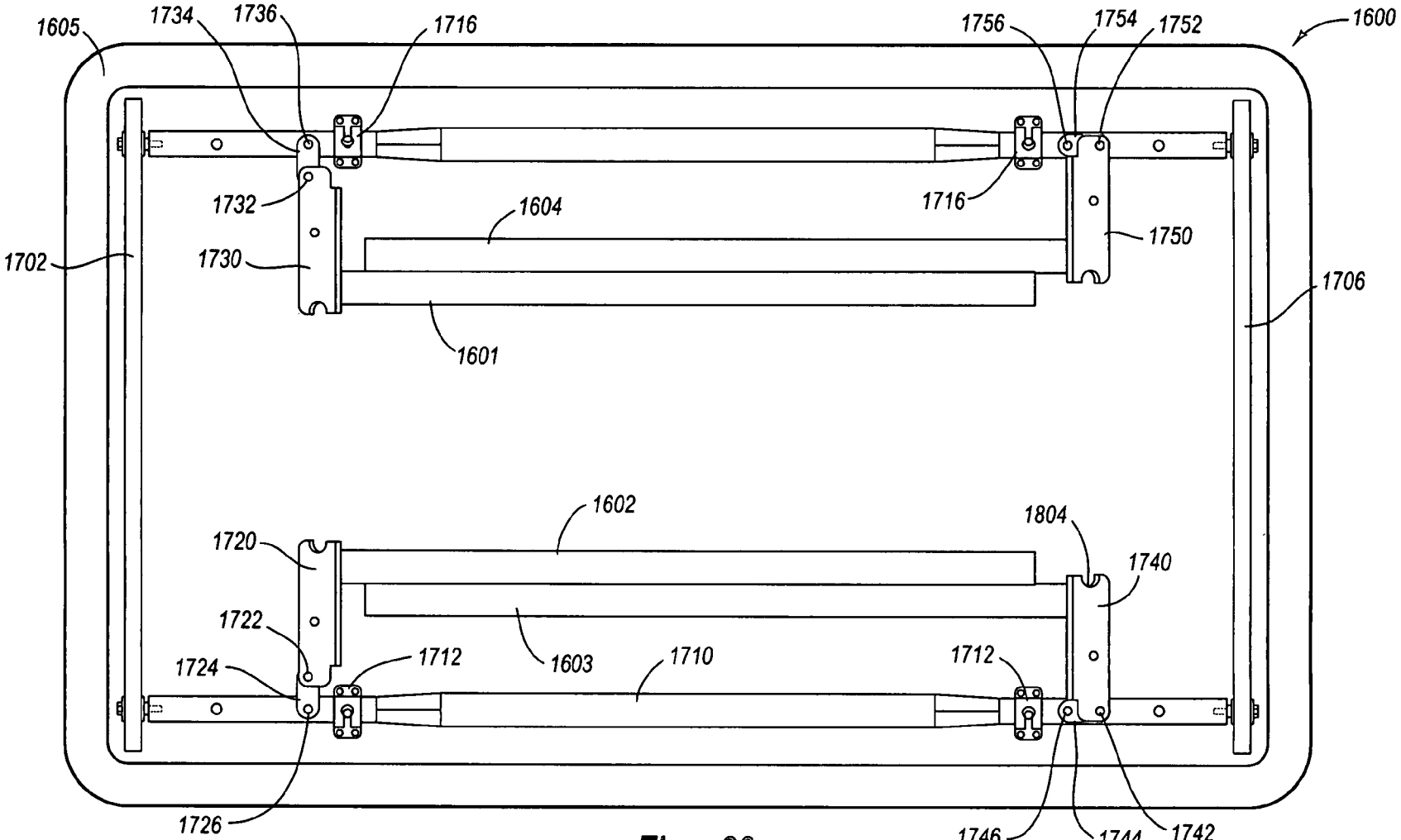
FIG. 20 is a bottom view of another exemplary embodiment of a table, illustrating the legs in a collapsed position.

As illustrated in FIG. 20, the legs 1601, 1602, 1603, 1604 may be positioned in a collapsed position. In the collapsed position, the bracket 1740 is preferably positioned in a substantially perpendicular direction to the side rail 1710, and the links 1744 are positioned in a substantially parallel direction with the side rail 1710. The bracket 1720 and the links 1724 are each positioned in a substantially perpendicular direction to the side rail 1710. Advantageously, because the side rail 1710 is preferably rotatably attached to the table 1600, the legs 1602, 1603 may be positioned proximate or adjacent to the lower surface of the table top. For example, as shown in FIG. 20, when the side rail 1710 has been rotated, the leg 1602 and the leg 1603 may be positioned generally adjacent to each other and near or contacting the lower surface of the table top. Similarly, the leg 1601 and leg 1604 may also be placed in a collapsed position with the legs disposed proximate or adjacent to the table top. In one embodiment, when the side rail 1710 is rotated, the links 1724 are positioned in a substantially parallel direction with the side rail and the links 1744 are each positioned in a substantially perpendicular direction to the side rail 1710.

Figure 21B:
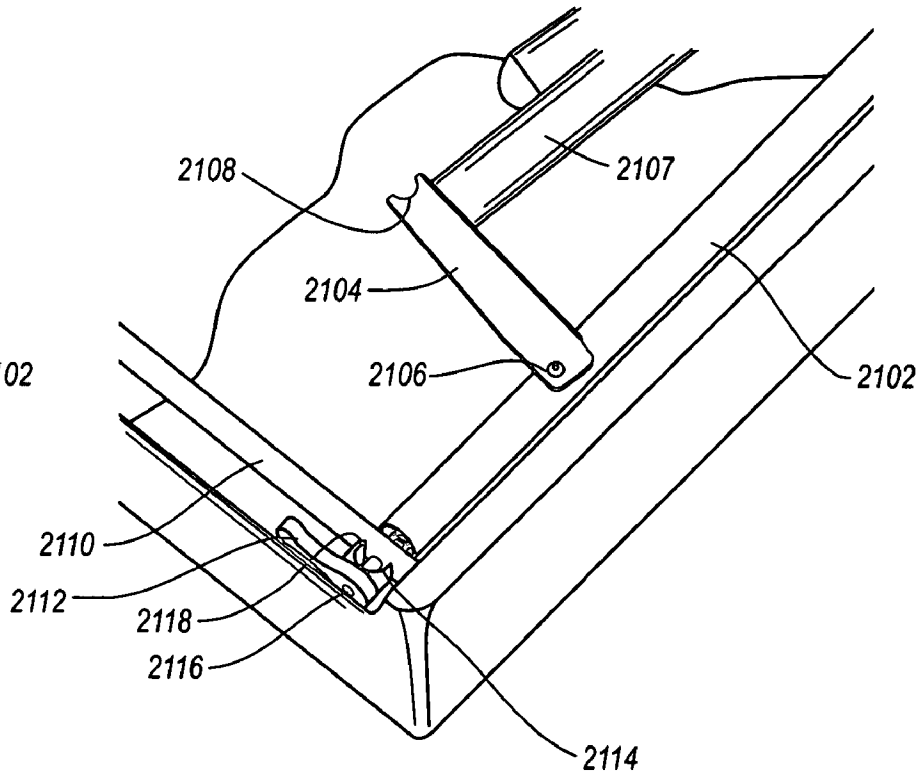
FIG. 21B is an enlarged perspective view of the portion of the table shown in FIG. 21A, illustrating the latch in a second position.
Figure 21A:
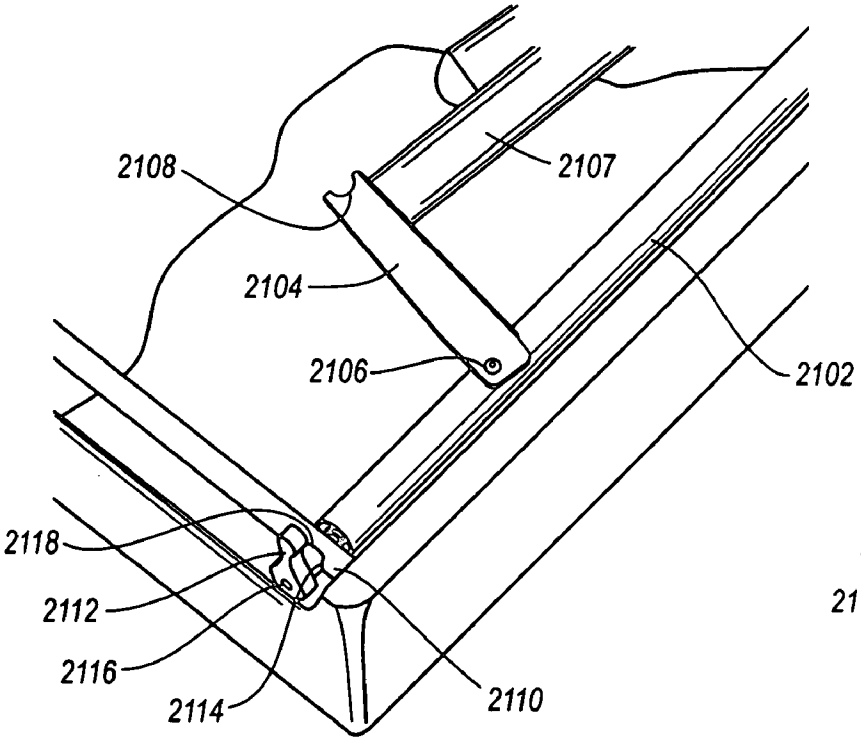
FIG. 21A is an enlarged perspective view of a portion of yet another exemplary embodiment of a table, illustrating a table leg in a first position and a latch in a first position.

As illustrated in FIG. 21A, the bracket 2104 may be coupled at a location 2106 to the side rail 2102. In addition, the side rail 2102 may be rotatably connected to the table top to allow the leg 2107 and the bracket 2104 to be disposed at an angle to the lower surface of the table top and to allow the leg and bracket to be disposed generally adjacent to the lower surface of the table top. In one embodiment, the bracket 2104 may include a curvilinear edge 2108 adapted to mate with or engage a portion of a crossbar 2110. The crossbar 2110 and/or side rail 2102 may be moved to allow the curvilinear edge 2108 of the bracket 2104 to mate with or engage the crossbar. A locking lever may be used to allow the crossbar 2110 and/or side rail 2102 to be moved to allow the edge 2108 of the bracket 2104 to engage the crossbar. The locking lever may also be used to secure the crossbar 2110 and/or side rail 2102 in a fixed position relative to the table top.

In greater detail, rotating the locking lever 2112 may move the crossbar member 2110 from a first position, as shown in FIG. 21A, in which the crossbar 2110 engages the curvilinear edge 2114 of the locking lever 2112 to a second position, as shown in FIG. 21B, in which the crossbar member may engage an edge 2118 and in which the crossbar 2110 may engage the edge 2108 of the bracket 2104. The locking lever may include a spring to bias the lever is an open or closed position, if desired. One skilled in the art will appreciate that any suitable type of device or structure may also be used to secure the components in the desired locations and position, and that a locking lever is not required.

Figure 22A:
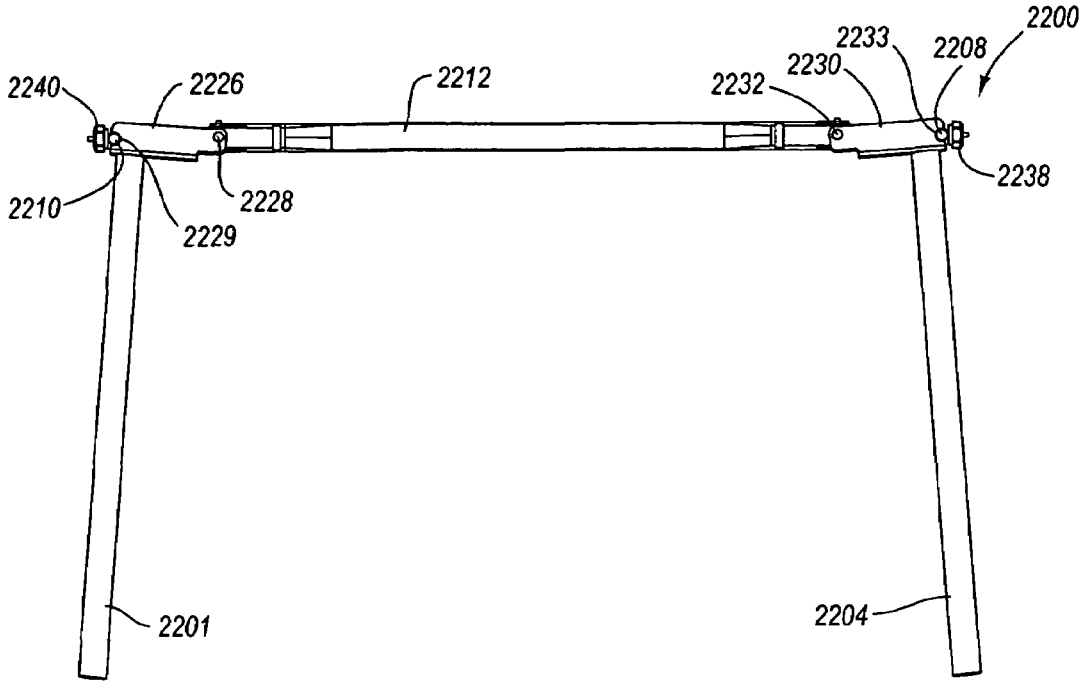
FIG. 22A is a side view of an exemplary embodiment of a frame for a table.
Figure 22B:
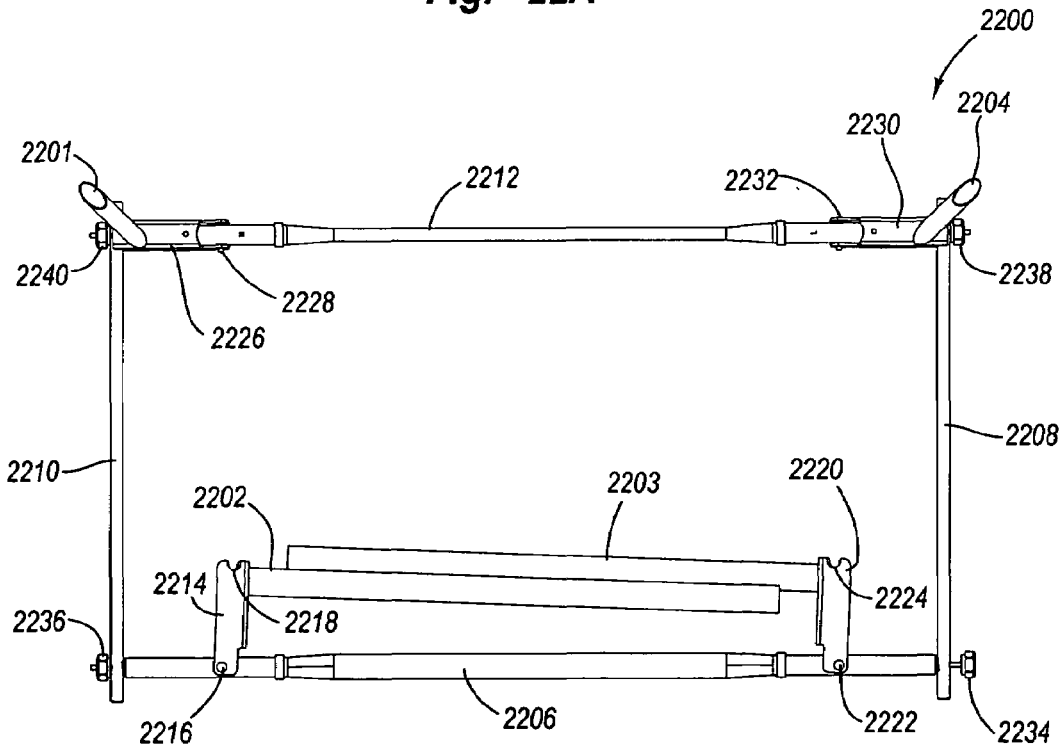
FIG. 22B is a bottom view of the frame shown in FIG. 22A, illustrating table legs in the extended position and table legs in the collapsed position.

As shown in FIGS. 22A and 22B, another exemplary embodiment of a frame 2200 and legs 2201, 2202, 2203, 2204 may be used to create a table. As discussed above, the table may include a table top that may be constructed from blow-molded plastic and the frame and legs may be constructed from metal tubes with generally circular or oblong cross sections. The table could also be constructed from other suitable materials with different sizes, shapes and configurations depending, for example, upon the intended use of the table As illustrated in FIGS. 22A and 22B, the frame 2200 may include a side rail 2206 that is rotatably coupled to a crossbar 2208 and a crossbar 2210. The frame 2200 may also include a side rail 2212 that is rotatably coupled to the crossbar 2208 and the crossbar 2210. A bracket 2214 is preferably pivotally coupled to the side rail 2206 at a location 2216 and a leg 2202 is preferably attached to the bracket. The bracket 2214 may include a curved portion 2218 that is adapted to engage a portion of the crossbar 2210. In addition, a second bracket 2220 is preferably pivotally coupled to the side rail 2206 at a location 2222 and a leg 2203 is preferably attached to the bracket. The bracket 2220 includes a curved portion 2224 that is adapted to engage a portion of the crossbar 2208. A third bracket 2226 is preferably pivotally coupled to the side rail 2212 at a location 2228 and a leg 2201 is preferably attached to the bracket. The bracket 2226 includes a curved portion 2229 that is adapted to engage a portion of the crossbar 2210. A fourth bracket 2230 is preferably pivotally coupled to the side rail 2212 at a location 2232 and a leg 2204 is preferably attached to the bracket. The bracket 2230 includes a curved portion 2233 that is adapted to engage a portion of the crossbar 2208. One or more knobs 2234, 2236, 2238, 2240 may be used to secure one or more legs in a particular position.

Figure 23:
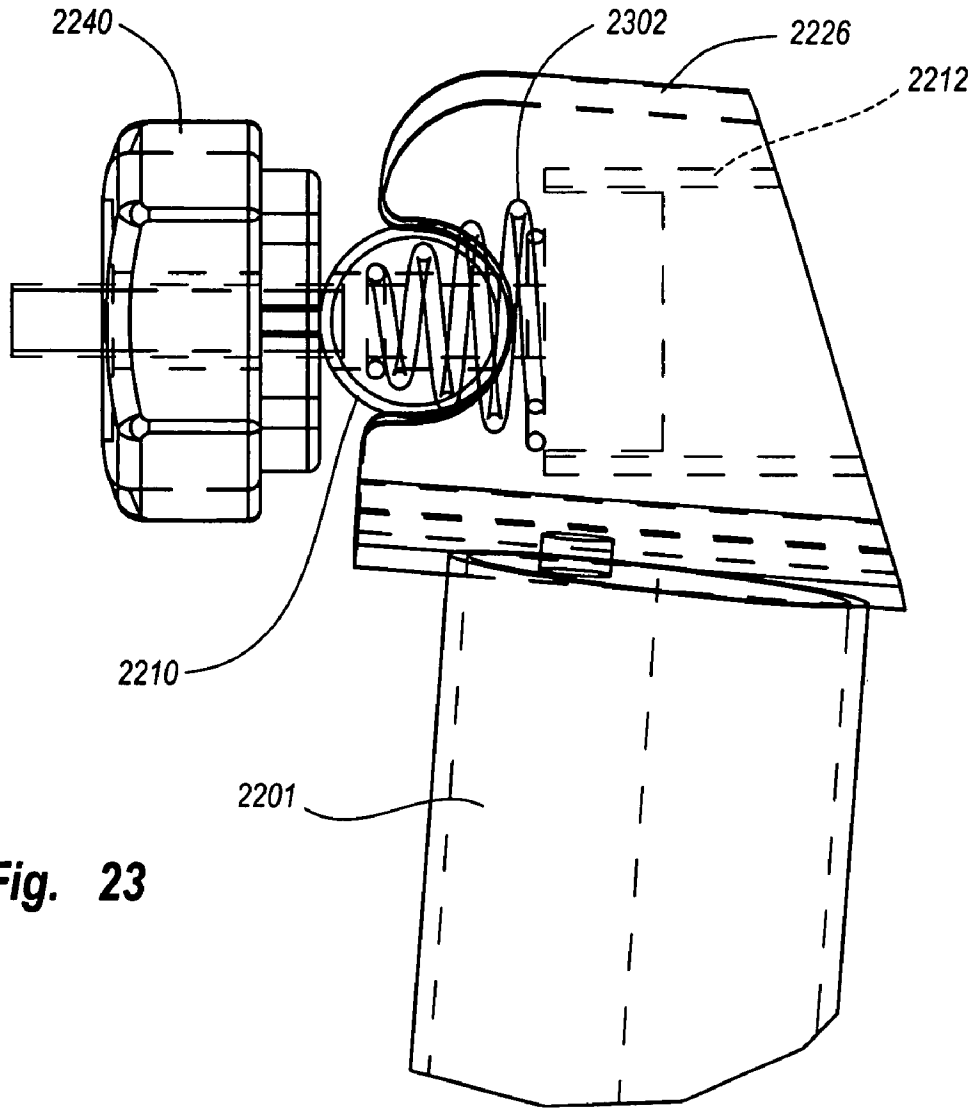
FIG. 23 is an enlarged side view of a portion of the frame shown in FIG. 22A.

For example, in one exemplary embodiment, when a knob is rotated, a corresponding crossbar is drawn towards a bracket having a curved portion adapted to engage the crossbar. In particular, as shown in FIG. 23, the knob 2240 may be rotated to draw the side rail 2212, which is secured to bracket 2226, closer to crossbar 2210. Accordingly, as the side rail 2212 is drawn closer to the crossbar 2210, the curved portion 2229 of the bracket 2212 engages the crossbar 2210 and this may lock the leg 2201 in an extended position. In another exemplary embodiment, rotating the knob 2240 may tense or tighten a spring 2302 and that force may draw the side rail 2212 closer to crossbar 2210.

Advantageously, the legs may be positioned to lie substantially flat or adjacent to a lower surface of the table top by disengaging the corresponding bracket from the corresponding crossbar and rotating the corresponding side rail. For example, as illustrated in FIG. 22B, the legs 2202, 2203 and brackets 2214, 2220 have been pivoted with respect to locations 2216 and 2222 respectively. Further, the legs 2202, 2203 and brackets 2214, 2220 have been rotated relative to the table top to allow the legs to be positioned adjacent to a lower surface of the table top. It will be appreciated that the legs and/or brackets could also be rotated at other directions and angles, and that the legs or brackets do not have to be rotated. In addition, the side rails 2206, 2212 do not have to be rotatably connected to the table top. Instead, for example, the legs and brackets may be rotatably connected to the side rails. One skilled in the art will appreciate that the frame 2200 could also have other suitable arrangements and configurations depending, for example, upon the intended use of the table. One skilled in the art will also appreciate that although the exemplary embodiments discussed above have been described with respect to tables, these aspects and features may also be used in connection with other types of furniture such as chairs, stools, footstools, or any other suitable type of devices or fixtures.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A table comprising:

a table top;

a frame secured to the table top, the frame including a first side rail and a second side rail;

a first bracket including an elongated body with a longitudinal axis, a first portion of the first bracket being pivotally connected to the first side rail of the frame in a fixed position;

a first leg connected to a second portion of the first bracket, the first leg movable between an extended position and a collapsed position relative to the table top, at least a portion of the first side rail being generally disposed between the first leg and the table top when the first leg is in the extended position, the first leg being at least substantially spaced apart from the first side rail when the first leg is in the collapsed position;

a second bracket including an elongated body with a longitudinal axis, a first portion of the second bracket being pivotally connected to the first side rail of the frame in a fixed position;

a second leg connected to a second portion of the second bracket, the second leg movable between an extended position and a collapsed position relative to the table top, at least a portion of the first side rail being generally disposed between the second leg and the table top when the second leg is in the extended position, the second leg being at least substantially spaced apart from the first side rail when the second leg is in the collapsed position;

a third bracket including an elongated body with a longitudinal axis, a first portion of the third bracket being pivotally connected to the second side rail of the frame in a fixed position;

a third leg connected to a second portion of the third bracket, the third leg movable between an extended position and a collapsed position relative to the table top, at least a portion of the second side rail being generally disposed between the third leg and the table top when the third leg is in the extended position, the third leg being at least substantially spaced apart from the second side rail when the third leg is in the collapsed position;

a fourth bracket including an elongated body with a longitudinal axis, a first portion of the fourth bracket being pivotally connected to the second side rail of the frame in a fixed position; and a fourth leg connected to a second portion of the fourth bracket, the fourth leg movable between an extended position and a collapsed position relative to the table top, at least a portion of the second side rail being generally disposed between the fourth leg and the table top when the fourth leg is in the extended position, the fourth leg being at least substantially spaced apart from the second side rail when the fourth leg is in the collapsed position;

wherein the elongated body of the first bracket is disposed generally parallel to and at least substantially proximate to the first side rail when the first leg is in the extended position, the elongated body of the first bracket being generally disposed at an angle and spaced part from the first side rail when the first leg is in the collapsed position;

wherein the elongated body of the second bracket is generally disposed parallel to and at least substantially proximate to the first side rail when the second leg is in the extended position, the elongated body of the second bracket being generally disposed at an angle and spaced part from the first side rail when the second leg is in the collapsed position;

wherein the elongated body of the third bracket is generally disposed parallel to and at least substantially proximate to the second side rail when the third leg is in the extended position, the elongated body of the third bracket being generally disposed at an angle and spaced part from the second side rail when the third leg is in the collapsed position; and wherein the elongated body of the fourth bracket is generally disposed parallel to and at least substantially proximate to the second side rail when the fourth leg is in the extended position, the elongated body of the fourth bracket being generally disposed at an angle and spaced part from generally disposed at an angle and spaced part from the second side rail when the fourth leg is in the collapsed position.

2. The table as in claim 1, wherein the first side rail is rotatably connected to the table top and the second side rail is rotatably connected to the table top.

3. The table as in claim 1, further comprising a first crossbar interconnecting the first bracket and the third bracket; and further comprising a second crossbar interconnecting the second bracket and the fourth bracket.

4. The table as in claim 1, further comprising a locking pin configured to secure the first leg member in an extended position.

5. The table as in claim 1, further comprising one or more clips that attach the first side rail and the second side rail to the table top.

6. The table as in claim 1, further comprising a first crossbar that interconnects the first side rail and the second side rail; and further comprising a second crossbar that interconnects the first side rail and the second side rail.

7. The table as in claim 6, further comprising one or more clips that attach the first crossbar and the second crossbar to the table top.

8. The table as in claim 1, wherein the first bracket can be pivoted relative to the table top to allow the first leg to be moved between the extended position and the collapsed position; and wherein the first bracket can be rotated relative to the table top to allow the first leg to be moved between a first position in which the first leg is spaced apart from an lower surface of the table top and a second position in which the first leg is positioned generally adjacent to the lower surface of the table top.

9. The table as in claim 1, wherein the first side rail can be rotated relative to the table top to allow the first leg to be spaced apart from a lower surface of the table top and to allow the first leg to be positioned generally proximate the lower surface of the table top.

10. The table as in claim 9, further comprising a lever that may be used to secure the first side rail in a fixed position.

11. The table as in claim 9, further comprising a knob that may be used to secure the first side rail in a fixed position.

12. A table comprising:

a table top;

a frame secured to the table top, the frame including a first side rail and a second side rail;

a first bracket including an elongated body with a longitudinal axis, a first portion of the first bracket being pivotally connected to the first side rail of the frame in a fixed position;

a first leg connected to a second portion of the first bracket, the first leg movable between an extended position and a collapsed position relative to the table top, at least a portion of the first side rail being generally disposed between the first leg and the table top when the first leg is in the extended position;

a second bracket including an elongated body with a longitudinal axis, a first portion of the second bracket being pivotally connected to the first side rail of the frame in a fixed position;

a second leg connected to a second portion of the second bracket, the second leg movable between an extended position and a collapsed position relative to the table top, at least a portion of the first side rail being generally disposed between the second leg and the table top when the second leg is in the extended position;

a third bracket including an elongated body with a longitudinal axis, a first portion of the third bracket being pivotally connected to the second side rail of the frame in a fixed position;

a third leg connected to a second portion of the third bracket, the third leg movable between an extended position and a collapsed position relative to the table top, at least a portion of the second side rail being generally disposed between the third leg and the table top when the third leg is in the extended position;

a fourth bracket including an elongated body with a longitudinal axis, a first portion of the fourth bracket being pivotally connected to the second side rail of the frame in a fixed position; and a fourth leg connected to a second portion of the fourth bracket, the fourth leg movable between an extended position and a collapsed position relative to the table top, at least a portion of the second side rail being generally disposed between the fourth leg and the table top when the fourth leg is in the extended position;

wherein the elongated body of the first bracket is disposed generally parallel to and at least substantially proximate to the first side rail when the first leg is in the extended position, the elongated body of the first bracket being generally disposed at an angle and spaced part from the first side rail when the first leg is in the collapsed position;

wherein the elongated body of the second bracket is generally disposed parallel to and at least substantially proximate to the first side rail when the second leg is in the extended position, the elongated body of the second bracket being generally disposed at an angle and spaced part from the first side rail when the second leg is in the collapsed position;

wherein the elongated body of the third bracket is generally disposed parallel to and at least substantially proximate to the second side rail when the third leg is in the extended position, the elongated body of the third bracket being generally disposed at an angle and spaced part from the second side rail when the third leg is in the collapsed position; and wherein the elongated body of the fourth bracket is generally disposed parallel to and at least substantially proximate to the second side rail when the fourth leg is in the extended position, the elongated body of the fourth bracket being generally disposed at an angle and spaced part from the second side rail when the fourth leg is in the collapsed position; and a drawer attached to the table tops, wherein the first leg, the second leg, the third leg and the fourth leg are sized and configured to be disposed about the drawer when the legs are in the collapsed position.

13. A table comprising:

a table top;

a frame secured to the table top, the frame including a first side rail and a second side rail;

a first bracket including an elongated body with a longitudinal axis, a first portion of the first bracket being pivotally connected to the first side rail of the frame in a fixed position;

a first leg connected to a second portion of the first bracket, the first leg movable between an extended position and a collapsed position relative to the table top, at least a portion of the first side rail being generally disposed between the first leg and the table top when the first leg is in the extended position;

a second bracket including an elongated body with a longitudinal axis, a first portion of the second bracket being pivotally connected to the first side rail of the frame in a fixed position;

a second leg connected to a second portion of the second bracket, the second leg movable between an extended position and a collapsed position relative to the table top, at least a portion of the first side rail being generally disposed between the second leg and the table top when the second leg is in the extended position;

a third bracket including an elongated body with a longitudinal axis, a first portion of the third bracket being pivotally connected to the second side rail of the frame in a fixed position;

a third leg connected to a second portion of the third bracket, the third leg movable between an extended position and a collapsed position relative to the table top, at least a portion of the second side rail being generally disposed between the third leg and the table top when the third leg is in the extended position;

a fourth bracket including an elongated body with a longitudinal axis, a first portion of the fourth bracket being pivotally connected to the second side rail of the frame in a fixed position; and a fourth leg connected to a second portion of the fourth bracket, the fourth leg movable between an extended position and a collapsed position relative to the table top, at least a portion of the second side rail being generally disposed between the fourth leg and the table top when the fourth leg is in the extended position;

wherein the elongated body of the first bracket is disposed generally parallel to and at least substantially proximate to the first side rail when the first leg is in the extended position, the elongated body of the first bracket being generally disposed at an angle and spaced part from the first side rail when the first leg is in the collapsed position;

wherein the elongated body of the second bracket is generally disposed parallel to and at least substantially proximate to the first side rail when the second leg is in the extended position, the elongated body of the second bracket being generally disposed at an angle and spaced part from the first side rail when the second leg is in the collapsed position;

wherein the elongated body of the third bracket is generally disposed parallel to and at least substantially proximate to the second side rail when the third leg is in the extended position, the elongated body of the third bracket being generally disposed at an angle and spaced part from the second side rail when the third leg is in the collapsed position; and wherein the elongated body of the fourth bracket is generally disposed parallel to and at least substantially proximate to the second side rail when the fourth leg is in the extended position, the elongated body of the fourth bracket being generally disposed at an angle and spaced part from the second side rail when the fourth leg is in the collapsed position;

wherein the first bracket is attached to a portion of the first side rail that is spaced apart from an end of the first side rail and wherein the first leg is generally aligned with the end of the first side rail when the first leg is in the extended position.

14. A table comprising:

a table top;

a frame secured to the table top, the frame including a first side rail and a second side rail;

a first bracket including an elongated body with a longitudinal axis, a first portion of the first bracket being pivotally connected to the first side rail of the frame in a fixed position;

a first leg connected to a second portion of the first bracket, the first leg movable between an extended position and a collapsed position relative to the table top, at least a portion of the first side rail being generally disposed between the first leg and the table top when the first leg is in the extended position;

a second bracket including an elongated body with a longitudinal axis, a first portion of the second bracket being pivotally connected to the first side rail of the frame in a fixed position;

a second leg connected to a second portion of the second bracket, the second leg movable between an extended position and a collapsed position relative to the table top, at least a portion of the first side rail being generally disposed between the second leg and the table top when the second leg is in the extended position;

a third bracket including an elongated body with a longitudinal axis, a first portion of the third bracket being pivotally connected to the second side rail of the frame in a fixed position;

a third leg connected to a second portion of the third bracket, the third leg movable between an extended position and a collapsed position relative to the table top, at least a portion of the second side rail being generally disposed between the third leg and the table top when the third leg is in the extended position;

a fourth bracket including an elongated body with a longitudinal axis, a first portion of the fourth bracket being pivotally connected to the second side rail of the frame in a fixed position; and a fourth leg connected to a second portion of the fourth bracket, the fourth leg movable between an extended position and a collapsed position relative to the table top, at least a portion of the second side rail being generally disposed between the fourth leg and the table top when the fourth leg is in the extended position;

wherein the elongated body of the first bracket is disposed generally parallel to and at least substantially proximate to the first side rail when the first leg is in the extended position, the elongated body of the first bracket being generally disposed at an angle and spaced part from the first side rail when the first leg is in the collapsed position;

wherein the elongated body of the second bracket is generally disposed parallel to and at least substantially proximate to the first side rail when the second leg is in the extended position, the elongated body of the second bracket being generally disposed at an angle and spaced part from the first side rail when the second leg is in the collapsed position;

wherein the elongated body of the third bracket is generally disposed parallel to and at least substantially proximate to the second side rail when the third leg is in the extended position, the elongated body of the third bracket being generally disposed at an angle and spaced part from the second side rail when the third leg is in the collapsed position; and wherein the elongated body of the fourth bracket is generally disposed parallel to and at least substantially proximate to the second side rail when the fourth leg is in the extended position, the elongated body of the fourth bracket being generally disposed at an angle and spaced part from the second side rail when the fourth leg is in the collapsed position;

wherein the first leg is generally parallel to and spaced apart from the first side rail when the first leg is in the collapsed position.

15. A table comprising:

a table top;

a frame secured to the table top, the frame including a first side rail and a second side rail;

a first bracket including an elongated body with a longitudinal axis, a first portion of the first bracket being pivotally connected to the first side rail of the frame in a fixed position;

a first leg connected to a second portion of the first bracket, the first leg movable between an extended position and a collapsed position relative to the table top, at least a portion of the first side rail being generally disposed between the first leg and the table top when the first leg is in the extended position;

a second bracket including an elongated body with a longitudinal axis, a first portion of the second bracket being pivotally connected to the first side rail of the frame in a fixed position;

a second leg connected to a second portion of the second bracket, the second leg movable between an extended position and a collapsed position relative to the table top, at least a portion of the first side rail being generally disposed between the second leg and the table top when the second leg is in the extended position;

a third bracket including an elongated body with a longitudinal axis, a first portion of the third bracket being pivotally connected to the second side rail of the frame in a fixed position;

a third leg connected to a second portion of the third bracket, the third leg movable between an extended position and a collapsed position relative to the table top, at least a portion of the second side rail being generally disposed between the third leg and the table top when the third leg is in the extended position;

a fourth bracket including an elongated body with a longitudinal axis, a first portion of the fourth bracket being pivotally connected to the second side rail of the frame in a fixed position;

a fourth leg connected to a second portion of the fourth bracket, the fourth leg movable between an extended position and a collapsed position relative to the table top, at least a portion of the second side rail being generally disposed between the fourth leg and the table top when the fourth leg is in the extended position;

a first link connecting the first side rail to the first bracket;

a second link connecting the first side rail to the second bracket;

a third link connecting the second side rail to the third bracket; and a fourth link connecting the second side rail to the fourth bracket;

wherein the elongated body of the first bracket is disposed generally parallel to and at least substantially proximate to the first side rail when the first leg is in the extended position, the elongated body of the first bracket being generally disposed at an angle and spaced part from the first side rail when the first leg is in the collapsed position;

wherein the elongated body of the second bracket is generally disposed parallel to and at least substantially proximate to the first side rail when the second leg is in the extended position, the elongated body of the second bracket being generally disposed at an angle and spaced part from the first side rail when the second leg is in the collapsed position;

wherein the elongated body of the third bracket is generally disposed parallel to and at least substantially proximate to the second side rail when the third leg is in the extended position, the elongated body of the third bracket being generally disposed at an angle and spaced part from the second side rail when the third leg is in the collapsed position; and wherein the elongated body of the fourth bracket is generally disposed parallel to and at least substantially proximate to the second side rail when the fourth leg is in the extended position, the elongated body of the fourth bracket being generally disposed at an angle and spaced part from the second side rail when the fourth leg is in the collapsed position.

16. The table as in claim 15, further comprising a first pin that is inserted through an opening in the first bracket to secure the first leg in the extended position; further comprising a second pin that is inserted through an opening in the second bracket to secure the second leg in the extended position; further comprising a third pin that is inserted through an opening in the third bracket to secure the third leg in the extended position; and further comprising a fourth pin that is inserted through an opening in the fourth bracket to secure the fourth leg in the extended position.

17. A table comprising:

a table top;

a frame secured to the table top, the frame including a first side rail and a second side rail;

a first bracket including an elongated body with a longitudinal axis, a first portion of the first bracket being pivotally connected to the first side rail of the frame in a fixed position;

a first leg connected to a second portion of the first bracket, the first leg movable between an extended position and a collapsed position relative to the table top, at least a portion of the first side rail being generally disposed between the first leg and the table top when the first leg is in the extended position;

a second bracket including an elongated body with a longitudinal axis, a first portion of the second bracket being pivotally connected to the first side rail of the frame in a fixed position;

a second leg connected to a second portion of the second bracket, the second leg movable between an extended position and a collapsed position relative to the table top, at least a portion of the first side rail being generally disposed between the second leg and the table top when the second leg is in the extended position;

a third bracket including an elongated body with a longitudinal axis, a first portion of the third bracket being pivotally connected to the second side rail of the frame in a fixed position;

a third leg connected to a second portion of the third bracket, the third leg movable between an extended position and a collapsed position relative to the table top, at least a portion of the second side rail being generally disposed between the third leg and the table top when the third leg is in the extended position;

a fourth bracket including an elongated body with a longitudinal axis, a first portion of the fourth bracket being pivotally connected to the second side rail of the frame in a fixed position; and a fourth leg connected to a second portion of the fourth bracket, the fourth leg movable between an extended position and a collapsed position relative to the table top, at least a portion of the second side rail being generally disposed between the fourth leg and the table top when the fourth leg is in the extended position;

wherein the elongated body of the first bracket is disposed generally parallel to and at least substantially proximate to the first side rail when the first leg is in the extended position, the elongated body of the first bracket being generally disposed at an angle and spaced part from the first side rail when the first leg is in the collapsed position;

wherein the elongated body of the second bracket is generally disposed parallel to and at least substantially proximate to the first side rail when the second leg is in the extended position, the elongated body of the second bracket being generally disposed at an angle and spaced part from the first side rail when the second leg is in the collapsed position;

wherein the elongated body of the third bracket is generally disposed parallel to and at least substantially proximate to the second side rail when the third leg is in the extended position, the elongated body of the third bracket being generally disposed at an angle and spaced part from the second side rail when the third leg is in the collapsed position;

wherein the elongated body of the fourth bracket is generally disposed parallel to and at least substantially proximate to the second side rail when the fourth leg is in the extended position, the elongated body of the fourth bracket being generally disposed at an angle and spaced part from the second side rail when the fourth leg is in the collapsed position;

wherein a portion of the first side rail is disposed within the first bracket when the first leg is in the extended position;

wherein a portion of the first side rail is disposed within the second bracket when the second leg is in the extended position;

wherein a portion of the second side rail is disposed within the third bracket when the third leg is in the extended position; and wherein a portion of the second side rail is disposed within the fourth bracket when the fourth leg is in the extended position.

18. A table comprising:

a table top;

a frame secured to the table top, the frame including a first side rail and a second side rail;

a first bracket including a first portion pivotally connected to the first side rail of the frame;

a first leg connected to a second portion of the first bracket, the first leg movable between an extended position and a collapsed position relative to the table top;

a second bracket including a first portion pivotally connected to the first side rail of the frame;

a second leg connected to a second portion of the second bracket, the second leg movable between an extended position and a collapsed position relative to the table top;

a third bracket including a first portion pivotally connected to the second side rail of the frame;

a third leg connected to a second portion of the third bracket, the third leg movable between an extended position and a collapsed position relative to the table top;

a fourth bracket including a first portion pivotally connected to the second side rail of the frame; and a fourth leg connected to a second portion of the fourth bracket, the fourth leg movable between an extended position and a collapsed position relative to the table top;

wherein the first side rail is rotatably connected to the table top and the second side rail is rotatably connected to the table top.

19. The table as in claim 18, further comprising a lever that may be used to secure the first side rail in a fixed position.

20. The table as in claim 18, further comprising a knob that may be used to secure the first side rail in a fixed position.

21. The table as in claim 18, wherein the first side rail can be rotated relative to the table top to allow the first leg to be spaced apart from a lower surface of the table top and to allow the first leg to be positioned generally proximate the lower surface of the table top.

22. The table as in claim 21, further comprising means for securing the first side rail in a fixed position.

23. A table comprising:

a table top;

a frame secured to the table top, the frame including a first side rail and a second side rail;

a first bracket including a first portion pivotally connected to the first side rail of the frame;

a first leg connected to a second portion of the first bracket, the first leg movable between an extended position and a collapsed position relative to the table top;

a second bracket including a first portion pivotally connected to the first side rail of the frame;

a second leg connected to a second portion of the second bracket, the second leg movable between an extended position and a collapsed position relative to the table top;

a third bracket including a first portion pivotally connected to the second side rail of the frame;

a third leg connected to a second portion of the third bracket, the third leg movable between an extended position and a collapsed position relative to the table top;

a fourth bracket including a first portion pivotally connected to the second side rail of the frame;

a fourth leg connected to a second portion of the fourth bracket, the fourth leg movable between an extended position and a collapsed position relative to the table top; and one or more clips that attach the first side rail and the second side rail to the table top.

24. A table comprising:

a table top;

a frame secured to the table top, the frame including a first side rail and a second side rail;

a first bracket including a first portion pivotally connected to the first side rail of the frame;

a first leg connected to a second portion of the first bracket, the first leg movable between an extended position and a collapsed position relative to the table top, the first leg being disposed generally perpendicular to the first side rail and the first bracket being disposed generally parallel to the first side rail when the first leg is in the extended position, the first leg being disposed generally parallel to and at least substantially spaced apart from the first side rail when the first leg is in the collapsed position, the first bracket being disposed generally perpendicular to the first side rail when the first leg is in the collapsed position;

a second bracket including a first portion pivotally connected to the first side rail of the frame;

a second leg connected to a second portion of the second bracket, the second leg movable between an extended position and a collapsed position relative to the table top, the second leg being disposed generally perpendicular to the first side rail and the second bracket being disposed generally parallel to the first side rail when the second leg is in the extended position, the second leg being disposed generally parallel to and at least substantially spaced apart from the first side rail when the second leg is in the collapsed position, the second bracket being disposed generally perpendicular to the first side rail when the second leg is in the collapsed position;

a third bracket including a first portion pivotally connected to the second side rail of the frame;

a third leg connected to a second portion of the third bracket, the third leg movable between an extended position and a collapsed position relative to the table top, the third leg being disposed generally perpendicular to the second side rail and the third bracket being disposed generally parallel to the second side rail when the third leg is in the extended position, the third leg being disposed generally parallel to and at least substantially spaced apart from the second side rail when the third leg is in the collapsed position, the third bracket being disposed generally perpendicular to the second side rail when the third leg is in the collapsed position;

a fourth bracket including a first portion pivotally connected to the second side rail of the frame; and a fourth leg connected to a second portion of the fourth bracket, the fourth leg movable between an extended position and a collapsed position relative to the table top, the fourth leg being disposed generally perpendicular to the second side rail and the fourth bracket being disposed generally parallel to the second side rail when the fourth leg is in the extended position, the fourth leg being disposed generally parallel to and at least substantially spaced apart from the second side rail when the fourth leg is in the collapsed position, the fourth bracket being disposed generally perpendicular to the second side rail when the fourth leg is in the collapsed position.

25. A table comprising:

a table top;

a frame secured to the table top, the frame including a first side rail and a second side rail;

a first bracket including a first portion pivotally connected to the first side rail of the frame;

a first leg connected to a second portion of the first bracket, the first leg movable between an extended position and a collapsed position relative to the table top;

a second bracket including a first portion pivotally connected to the first side rail of the frame;

a second leg connected to a second portion of the second bracket, the second leg movable between an extended position and a collapsed position relative to the table top;

a third bracket including a first portion pivotally connected to the second side rail of the frame;

a third leg connected to a second portion of the third bracket, the third leg movable between an extended position and a collapsed position relative to the table top;

a fourth bracket including a first portion pivotally connected to the second side rail of the frame; and a fourth leg connected to a second portion of the fourth bracket, the fourth leg movable between an extended position and a collapsed position relative to the table top;

wherein the first side rail can be rotated relative to the table top to allow the first leg to be spaced apart from a lower surface of the table top and to allow the first leg to be positioned generally proximate the lower surface of the table top.

26. The table as in claim 25, further comprising a lever that may be used to secure the first side rail in a fixed position.

27. The table as in claim 25, further comprising a knob that may be used to secure the first side rail in a fixed position.

28. A table comprising:

a table top;

a frame secured to the table top, the frame including a first side rail and a second side rail;

a first bracket including a first portion pivotally connected to the first side rail of the frame;

a first leg connected to a second portion of the first bracket, the first leg movable between an extended position and a collapsed position relative to the table top;

a second bracket including a first portion pivotally connected to the first side rail of the frame;

a second leg connected to a second portion of the second bracket, the second leg movable between an extended position and a collapsed position relative to the table top;

a third bracket including a first portion pivotally connected to the second side rail of the frame;

a third leg connected to a second portion of the third bracket, the third leg movable between an extended position and a collapsed position relative to the table top;

a fourth bracket including a first portion pivotally connected to the second side rail of the frame;

a fourth leg connected to a second portion of the fourth bracket, the fourth leg movable between an extended position and a collapsed position relative to the table top; and a first pin that is sized and configured to be inserted into an opening in the first bracket and a first opening in the first side rail to secure the first leg in the extended position.

29. The table as in claim 28, further comprising a second pin that is sized and configured to be inserted into an opening in the second bracket and a second opening in the first side rail to secure the second leg in the extended position, a third pin that is sized and configured to be inserted into an opening in the third bracket and a first opening in the second side rail to secure the third leg in the extended position, and a fourth pin that is sized and configured to be inserted into an opening in the fourth bracket and a second opening in the second side rail to secure the fourth leg in the extended position.

* * * * *

UNITED STATES PATENT AND TRADEMARK OFFICE

CERTIFICATE OF CORRECTION

PATENT NO. : 7,063,025 B2
APPLICATION NO. : 10/821566
DATED : June 20, 2006
INVENTOR(S) : Ashby et al.

It is certified that error appears in the above-identified patent and that said Letters Patent is hereby corrected as shown below:

Title Page
Item 63, Related U.S. Application Data, lines 2-3, change “501,103, which is” to --501,103; and--

Column 4
Line 34, remove “game”

Column 8
Line 58, after “frame.” remove “,”

Column 10
Line 44, change “crossbar” to --crossbars--

Column 11
Line 45, after “constructed” insert --from--
Line 64, change “101, 102, 103, 104” to --701, 702, 703, 704--

Column 12
Line 55, after “pivotally” insert --connected--

Column 14
Line 45, change “1706” to --1708--
Line 47, change “1706” to --1708--

Column 15
Line 13, change “forth” to --fourth--

UNITED STATES PATENT AND TRADEMARK OFFICE

CERTIFICATE OF CORRECTION

PATENT NO. : 7,063,025 B2
APPLICATION NO. : 10/821566
DATED : June 20, 2006
INVENTOR(S) : Ashby et al.

It is certified that error appears in the above-identified patent and that said Letters Patent is hereby corrected as shown below:

Column 16
Line 50, change "is" to --in--

Column 17
Line 30, change "2212" to --2226--

Signed and Sealed this

Second Day of January, 2007

JON W. DUDAS
*Director of the United States Patent and Trademark Office*